US009250600B2

(12) United States Patent
Souda

(10) Patent No.: US 9,250,600 B2
(45) Date of Patent: Feb. 2, 2016

(54) IMAGE FORMING APPARATUS INCLUDING RESIN FRAME FOR SUPPORTING IMAGE FORMING UNITS HAVING PHOTOSENSITIVE MEMBERS

(71) Applicant: Brother Kogyo Kabushiki Kaisha, Nagoya-shi, Aichi-ken (JP)

(72) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/541,214

(22) Filed: Nov. 14, 2014

(65) Prior Publication Data

US 2015/0139679 A1 May 21, 2015

(30) Foreign Application Priority Data

Nov. 15, 2013 (JP) ..... 2013-237326

(51) Int. Cl.
*G03G 15/00* (2006.01)
*G03G 21/16* (2006.01)

(52) U.S. Cl.
CPC ..... *G03G 21/1619* (2013.01)

(58) Field of Classification Search
CPC ..... G03G 21/1619; G03G 21/1671; G03G 21/1676; G03G 21/1842; G03G 21/1853; G03G 2215/0141; G03G 2221/166; G03G 21/16
USPC ..... 399/90
See application file for complete search history.

(56) References Cited

U.S. PATENT DOCUMENTS

| | | | | |
|---|---|---|---|---|
| 8,116,652 | B2 * | 2/2012 | Okabe | 399/90 |
| 8,175,491 | B2 | 5/2012 | Tomatsu et al. | |
| 2007/0071482 | A1 * | 3/2007 | Okabe | 399/90 |
| 2007/0286632 | A1 * | 12/2007 | Okabe | 399/90 |
| 2010/0014887 | A1 | 1/2010 | Tomatsu et al. | |
| 2011/0129276 | A1 * | 6/2011 | Kondo | G03G 21/1695 400/613 |
| 2013/0077990 | A1 * | 3/2013 | Nakashima | G03G 21/1619 399/107 |
| 2013/0322945 | A1 * | 12/2013 | Nishimura | G03G 15/6558 399/395 |
| 2015/0177680 | A1 * | 6/2015 | Souda | G03G 21/1619 399/107 |

FOREIGN PATENT DOCUMENTS

JP 2010-044363 A 2/2010

* cited by examiner

*Primary Examiner* — Francis Gray
(74) *Attorney, Agent, or Firm* — Banner & Witcoff, Ltd.

(57) ABSTRACT

An image forming apparatus includes a plurality of image forming units in an arrangement direction orthogonal to a rotary axis thereof; a support member configured to support the plurality of image forming units; a frame, which is configured to support the support member, and a plurality of electrodes, which is supported to the frame and is configured to supply power to the plurality of image forming units, wherein the frame comprises: a plurality of support projections, which protrudes inwardly to support the plurality of electrodes, and a projection part, which is arranged at an outer position of the plurality of support projections, at which the projection part overlaps with the support member, as viewed from the direction of the rotary axis, and is contactable to the support member in a case where the support member is moved towards the frame.

13 Claims, 21 Drawing Sheets

IMAGE FORMING APPARATUS INCLUDING RESIN FRAME FOR SUPPORTING IMAGE FORMING UNITS HAVING PHOTOSENSITIVE MEMBERS

CROSS-REFERENCE TO RELATED APPLICATION

This application claims priority from Japanese Patent Application No. 2013-237326 filed on Nov. 15, 2013, the entire subject matter of which is incorporated herein by reference.

TECHNICAL FIELD

This disclosure relates to an image forming apparatus having a frame made of resin for supporting image forming units having a plurality of photosensitive drums.

BACKGROUND

In the related art, an image forming apparatus has been known in which side frames for moveably supporting a drawer configured to support a plurality of process cartridges (image forming units) are configured by metallic frames having high stiffness. Specifically, according to this technology, the side frames arranged at side surfaces of the image forming units are configured by the metallic frames and a resin frame is coupled to lower ends of the metallic frames.

SUMMARY

However, according to the background art, since the side frames are configured by the metallic frames, a weight of the image forming apparatus is increased. Regarding this, it is considered to configure the side frames with resin frames. In this case, however, the stiffness of the side frames is lowered.

Specifically, in a case where the image forming apparatus is dropped from a high position and where the drawer is moved towards the side frame and thus collides with the same, for example, if a load of the drawer is concentrated on a central part of the side frame, the side frame is deformed from the central part. It is thought that the problem is caused because a plurality of electrodes for supplying power to each process cartridge is provided at the central parts of the side frames. Specifically, a plurality of support projections for surrounding and supporting the plurality of electrodes is formed to protrude towards the drawer on inner surfaces of the side frames. Thus, when the drawer is moved towards the side frame due to the dropping of the image forming apparatus, for example, the load from the drawer is concentrated on the plurality of support projections at the central part of the side frame, so that the central part of the side frame is concavely deformed.

This disclosure may provide an image forming apparatus configured to lighten and to suppress a frame from being deformed when a load is applied to the frame from a drawer.

According to an aspect of the present invention, an image forming apparatus includes: a plurality of image forming units respectively having a photosensitive drum rotatable about a rotary axis and arranged side by side in an arrangement direction orthogonal to the rotary axis; a support member configured to support the plurality of image forming units; a frame, which is made of resin, is arranged at one end-side of the photosensitive drum in a direction of the rotary axis and is configured to support the support member, and a plurality of electrodes, which is supported to the frame and is configured to supply power to the plurality of image forming units, wherein the frame comprises: a plurality of support projections, which protrudes inwardly from an inner surface of the frame and is configured to support the plurality of electrodes, and a projection part, which is arranged at an outer position of the plurality of support projections, at which the projection part overlaps with the support member, as viewed from the direction of the rotary axis, and is contactable to the support member in a case where the support member is moved towards the frame.

According to the above image forming apparatus, since the frame is made of resin, it is possible to lighten the image forming apparatus, as compared to a structure where the frame is made of metal, like the background art. Also, since the projection part is arranged at the outer side of the plurality of support projections, it is possible to arrange the projection part at a closer position to an end portion of the frame than the plurality of support projections, for example. In this case, when the image forming apparatus is dropped, for example, and the support member is thus moved towards the frame and is contacted to the projection part, a load transmitted from the support member is transmitted to the end portion of the frame, which is relatively difficult to be deformed. For this reason, it is possible to suppress deformation of the frame made of resin, as compared to a structure where the load is transmitted to a central part of the frame upon the dropping of the image forming apparatus, for example. Also, the projection part is arranged at the outer side of the plurality of support projections, so that when the heights (protruding amounts) of the projection part and the plurality of support projections are made to be substantially the same, the load applied from the support member to the frame can be dispersed and transmitted to the frame by the respective support projections and the projection part. Therefore, it is possible to suppress the deformation of the frame.

According to this disclosure, it is possible to lighten the image forming apparatus and to suppress the frame from being deformed when the load is applied to the frame from the support member.

BRIEF DESCRIPTION OF THE DRAWINGS

The foregoing and additional features and characteristics of this disclosure will become more apparent from the following detailed descriptions considered with the reference to the accompanying drawings, wherein:

FIG. 10 is a sectional view illustrating a relation between each beam-shaped plate and a process unit and the like;

DETAILED DESCRIPTION

Hereinafter, an illustrative embodiment of this disclosure will be described in detail with reference to the drawings. In the below descriptions, an overall configuration of a color printer, which is an example of the image forming apparatus, will be first described and the features of this disclosure will be then described in detail.

In the below descriptions, the directions are described on the basis of a user who uses the color printer. That is, the left of FIG. 1 is referred to as the 'front side,' the right of FIG. 1 is referred to as the 'rear side,' the inner side of FIG. 1 is referred to as the 'left side' and the front side of FIG. 1 is referred to as the 'right side.' Also, the upper and lower directions of FIG. 1 are referred to as the 'upper-lower direction.'

Figure 1:
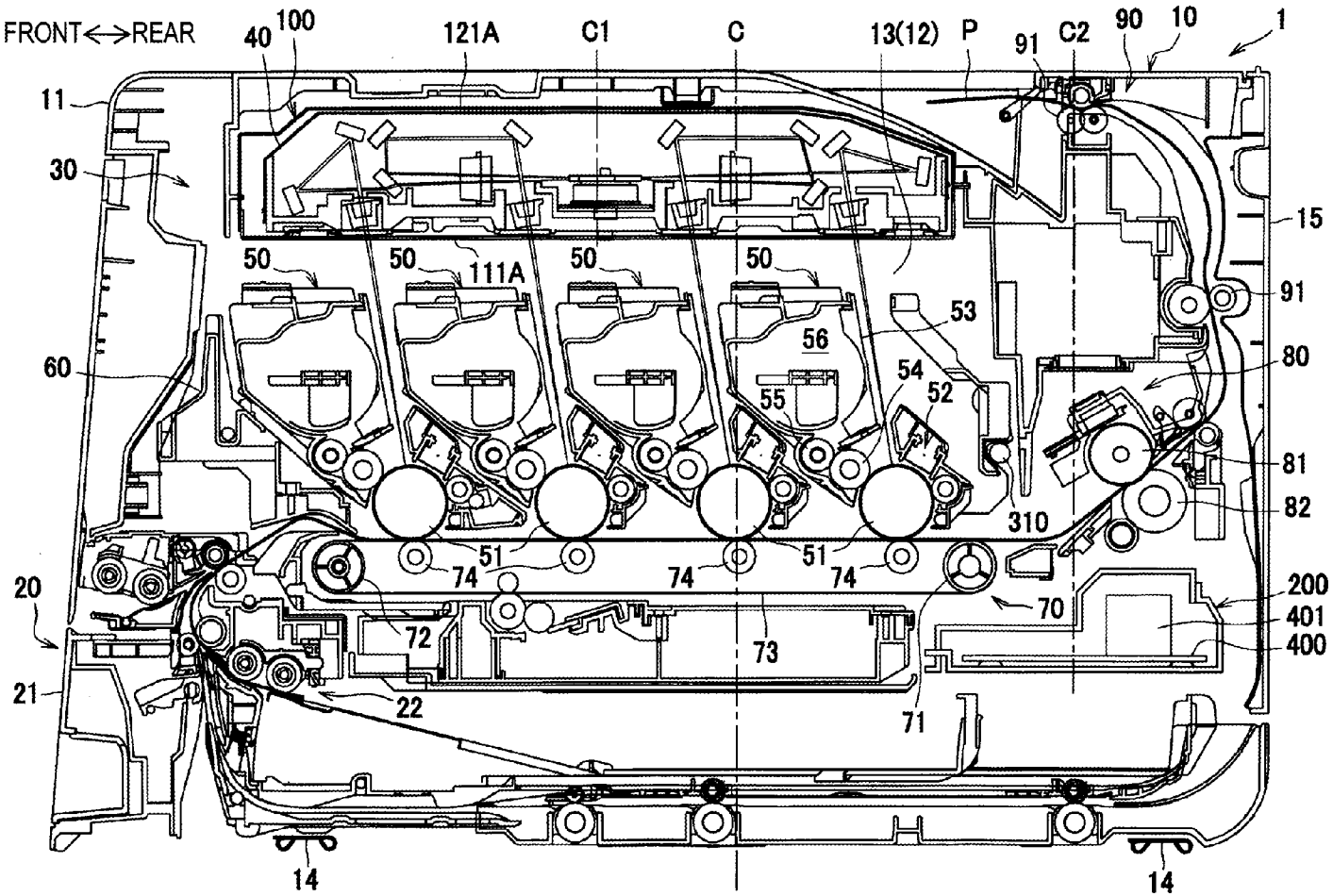
FIG. 1 is a sectional view illustrating a color printer according to an illustrative embodiment of this disclosure.

As shown in FIG. 1, a color printer 1 has, in an apparatus main body 10, a feeder unit 20 configured to feed a sheet P, an image forming part 30 configured to form an image on the fed sheet P, and a sheet discharge unit 90 configured to discharge the sheet P having an image formed thereon. Meanwhile, a structure of the apparatus main body 10 will be described in detail later.

The feeder unit 20 is mainly provided with a sheet feeding tray 21 configured to accommodate therein the sheet P and a sheet conveyance device 22 configured to convey the sheet P from the sheet feeding tray 21 to the image forming part 30.

The image forming part 30 is mainly provided with a light scanner 40, four process units 50, which are an example of a plurality of image forming units, a drawer 60, which is an example of a support member, a transfer unit 70 and a fixing unit 80.

The light scanner 40 is arranged at an upper side of the plurality of process units 50 (at one side in an orthogonal direction orthogonal to rotary axis directions and an arrangement direction of photosensitive drums 51, which will be described later), and has a laser light emitting unit (not shown), a polygon mirror, lens, a reflector and the like of which reference numerals are omitted. In the light scanner 40, a laser beam is reflected on the polygon mirror and the reflector, passes through the lens and is illuminated onto surfaces of the respective photosensitive drums 51 of the respective process units 50 by high-speed scanning.

The plurality of process units 50 is arranged in an arrangement direction orthogonal to the rotary axes of the photosensitive drums 51, i.e., in a front-rear direction, in this illustrative embodiment. The process unit 50 has the photosensitive drum 51 that is rotatable about the rotary axis along the left-right direction, a charger 52 for charging the photosensitive drum 51 and a developing cartridge 53. The developing cartridge 53 has a developing roller 54 and a supply roller 55 for supplying toner to the photosensitive drum 51, and a toner accommodation chamber 56 for accommodating therein the toner.

The charger 52 has a charging wire 52A and a grid electrode 52B provided between the charging wire 52A and the photosensitive drum 51.

Figure 2:
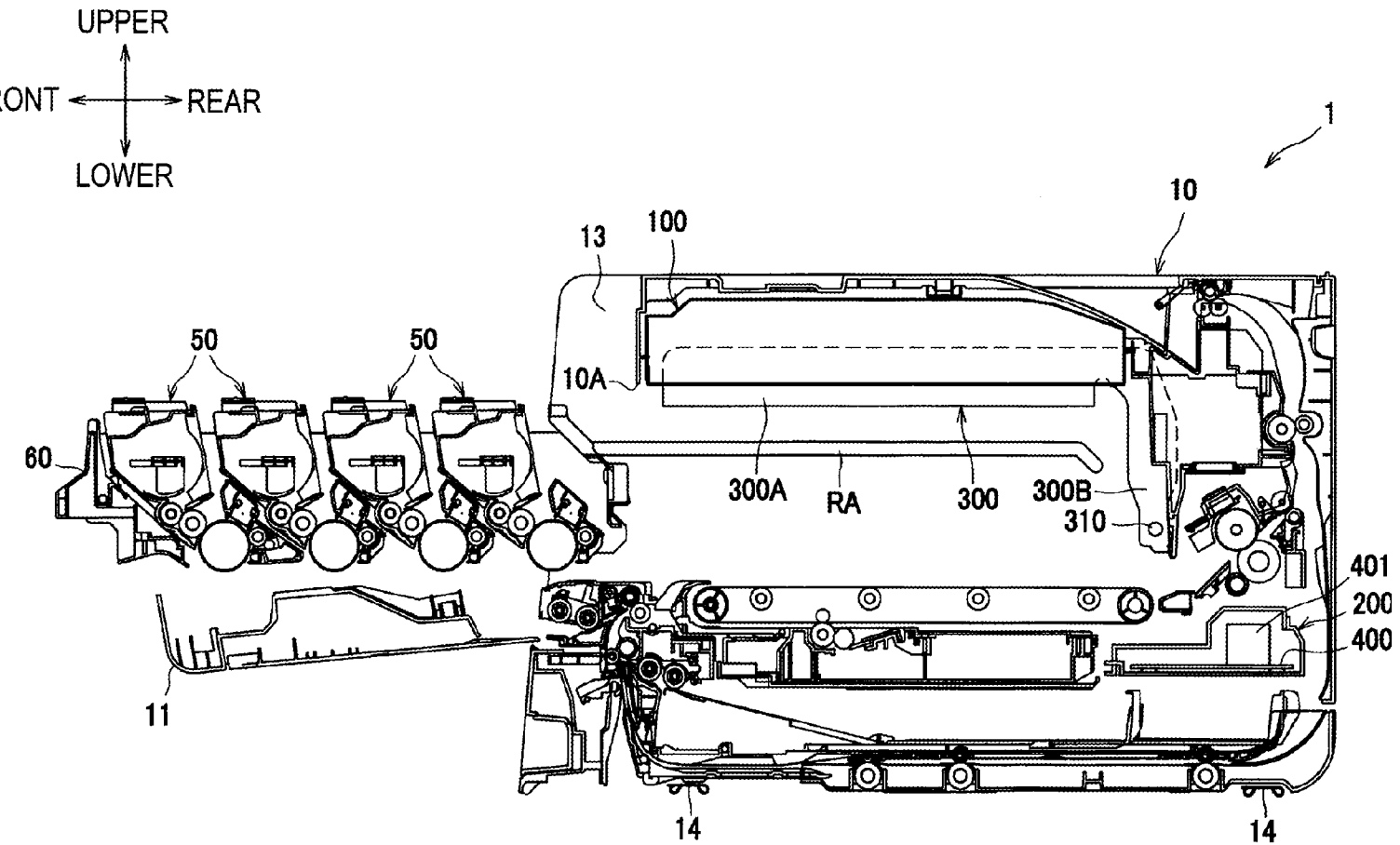
FIG. 2 is a sectional view illustrating a state where a drawer is pulled out from an apparatus main body.
Figure 3:
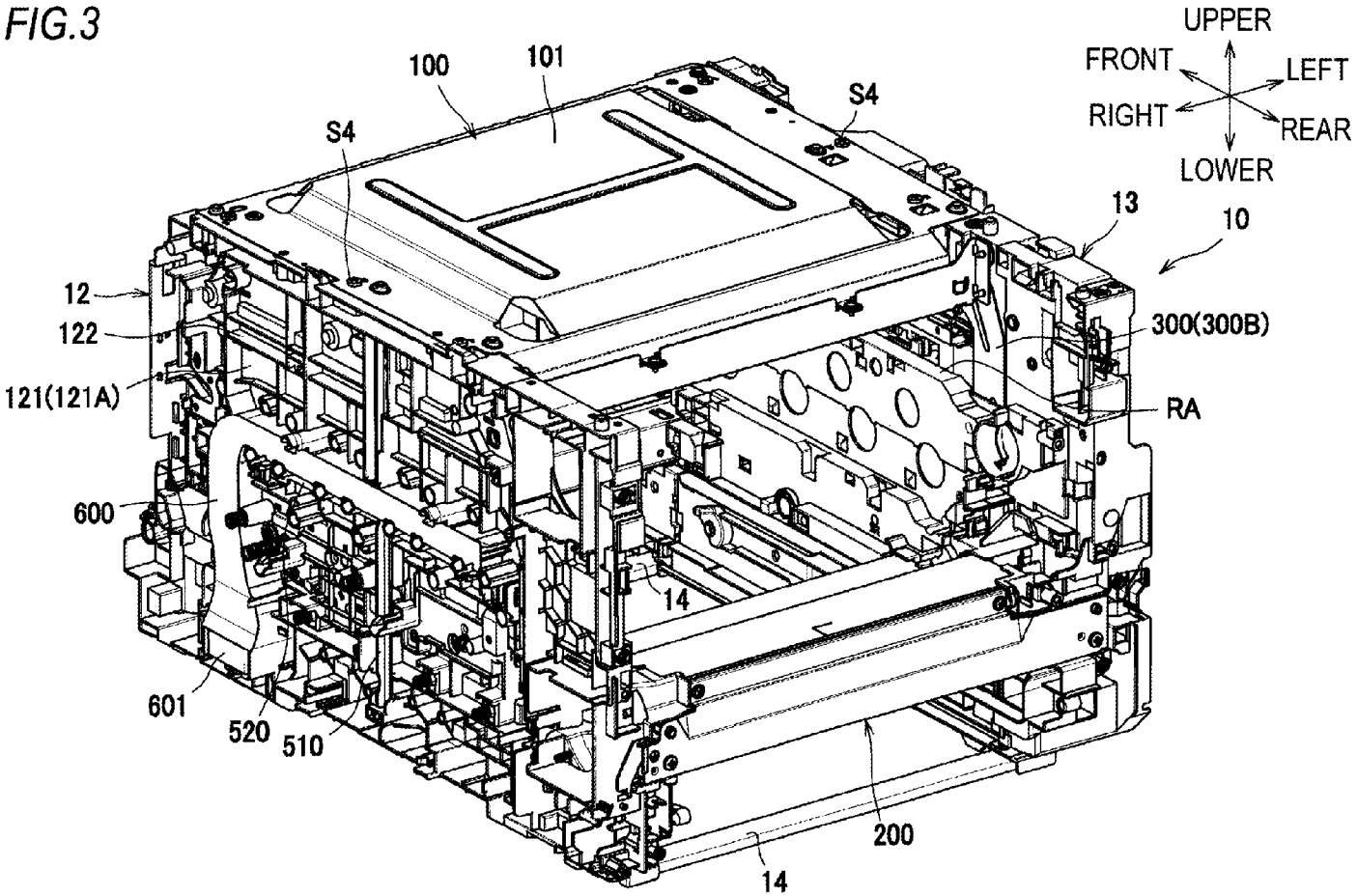
FIG. 3 is a perspective view illustrating a configuration of the apparatus main body.

The drawer 60 is a member for supporting the plurality of process units 50 and is configured to be moveable in the front-rear direction with respect to a pair of side frames 12, 13 configuring left and right walls of the apparatus main body 10. Specifically, each of the side frames 12, 13 is provided with a rail RA (only left side is shown in FIGS. 2 and 3) extending in the front-rear direction, and the drawer 60 can be moved in the front-rear direction with being guided by the respective rails RA. As shown in FIG. 2, the drawer 60 can be pulled out to an outside of the apparatus main body 10 through an opening 10A, which is formed by opening a front cover 11 arranged on a front surface of the apparatus main body 10. Thereby, the process units 50 can be exposed to the outside.

Returning to FIG. 1, the transfer unit 70 is provided between the feeder unit 20 and the drawer 60, and has a driving roller 71, a driven roller 72, a conveyance belt 73 and transfer rollers 74.

The driving roller 71 and the driven roller 72 are arranged in parallel with being spaced from each other in the front-rear direction, and the conveyance belt 73 consisting of an endless belt is provided with being tensioned therebetween. The conveyance belt 73 is mounted so that an outer surface thereof contacts the respective photosensitive drums 51. Also, at an inner side of the conveyance belt 73, the four transfer rollers 74 configured to hold the conveyance belt 73 between the respective photosensitive drums 51 and the transfer rollers 74 are arranged to face the respective photosensitive drums 51. A transfer bias is applied to the transfer rollers 74 upon the transfer by a constant current control.

The fixing unit 80 is arranged at the rear side of the drawer 60 and the transfer unit 70, and has a heating roller 81 and a pressing roller 82 arranged to face the heating roller 81 and configured to press the heating roller 81.

In the image forming part 30 configured as described above, the surface of each photosensitive drum 51 is uniformly charged by the charger 52 and is then exposed by the light scanner 40. Thereby, charges of the exposed part are removed, so that an electrostatic latent image based on image data is formed on each photosensitive drum 51. After that, the toner in the developing cartridge 53 is supplied to the electrostatic latent image on the photosensitive drum 51 by the developing roller 54, so that a toner image is carried on the photosensitive drum 51.

Then, the sheet P fed onto the conveyance belt 73 passes between the respective photosensitive drums 51 and the respective transfer rollers 74, so that the toner images formed on the respective photosensitive drums 51 are transferred onto the sheet P. Then, the sheet P passes between the heating roller 81 and the pressing roller 82, so that the toner images transferred on the sheet P are heat-fixed.

The sheet discharge unit 90 is mainly provided with a plurality of conveyance rollers 91 configured to convey the sheet P. The sheet P having the toner images transferred and heat-fixed thereon is conveyed by the conveyance rollers 91 and is discharged to the outside of the apparatus main body 10.

<Configuration of Apparatus Main Body 10>

As shown in FIG. 3, the apparatus main body 10 has the pair of left and right side frames 12, 13, a first coupling frame 100 configured to connect upper parts of the respective side frames 12, 13, a second coupling frame 200 configured to connect lower-rear parts of the respective side frames 12, 13 and lower beams 14 configured to connect lower end portions of the respective side frames 12, 13. The lower beams 14 are long plates in a left-right direction and are respectively provided at the front and rear sides of the respective side frames 12, 13.

The respective side frames 12, 13 are frames made of resin and having a substantially rectangular plate shape, and are configured to face each other with the plurality of process units 50 being held therebetween in the left-right direction and to support the respective process units 50 via the drawer 60, as shown in FIG. 1. Meanwhile, in the below descriptions, the side frame 12 arranged at the right side is also referred to as the right side frame 12, and the side frame 13 arranged at the left side is also referred to as the left side frame 13.

The right side frame 12 is an example of a frame and is configured to support right ends of the respective process units 50 via the drawer 60. As shown in FIG. 3, the right side frame 12 mainly has a plate-shaped part 121 having a plane 121A orthogonal to the left-right direction and a reinforcement rib part 122 formed to protrude inwardly or outwardly from the plate-shaped part 121 in the left-right direction. The right side frame 12 is reinforced by a first beam-shaped plate 510 and a second beam-shaped plate 520 (refer to FIG. 5), which will be described later.

The left side frame 13 is configured to face the right side frame 12 with the process units 50 being held therebetween and to support left ends of the respective process units 50 via the drawer 60. In the meantime, the left side frame 13 also has the same plate-shaped part and reinforcement rib part (the reference numerals thereof are omitted) as the right side frame 12. Also, a driving mechanism (not shown) configured by a plurality of gears and the like for driving the photosensitive drums 51 and the like is provided on an outer side of the left side frame 13 in the left-right direction, and the left side frame 13 is reinforced by the driving mechanism.

As shown in FIGS. 3 and 1, the first coupling frame 100 is a metallic frame and has a cylindrical shape of which a section orthogonal to the left-right direction has a closed sectional shape, and both end portions thereof in the left-right direction are connected to the pair of side frames 12, 13. The first coupling frame 100 is arranged above the plurality of process units 50 and the light scanner 40 is accommodated therein.

In this way, both end portions of the first coupling frame 100 having the cylindrical shape are connected to the pair of side frames 12, 13, so that the stiffness of the pair of side frames 12, 13 can be increased. Also, since the light scanner 40 is accommodated in the first coupling frame 100 having the cylindrical shape, it is possible to provide the first coupling frame 100 with both a function of improving the stiffness of the pair of side frames 12, 13 and a function of protecting the light scanner 40.

Also, the first coupling frame 100 has substantially the same size as the drawer 60 in the front-rear direction, and is configured to overlap with the plurality of process units 50 when projected in an upper-lower direction. In this way, the first coupling frame 100 is formed over the substantial entirety of the plurality of process units 50, so that it is possible to further improve the stiffness of the pair of side frames 12, 13.

Also, a center C1 of the first coupling frame 100 in the front-rear direction is arranged to deviate forwardly with respect to a center C of the side frames 12, 13 in the front-rear direction. In other words, the first coupling frame 100 is arranged to be close to front ends of the side frames 12, 13 (i.e., at a position closer to the front ends of the side frames 12, 13 than rear ends thereof).

Figure 4:
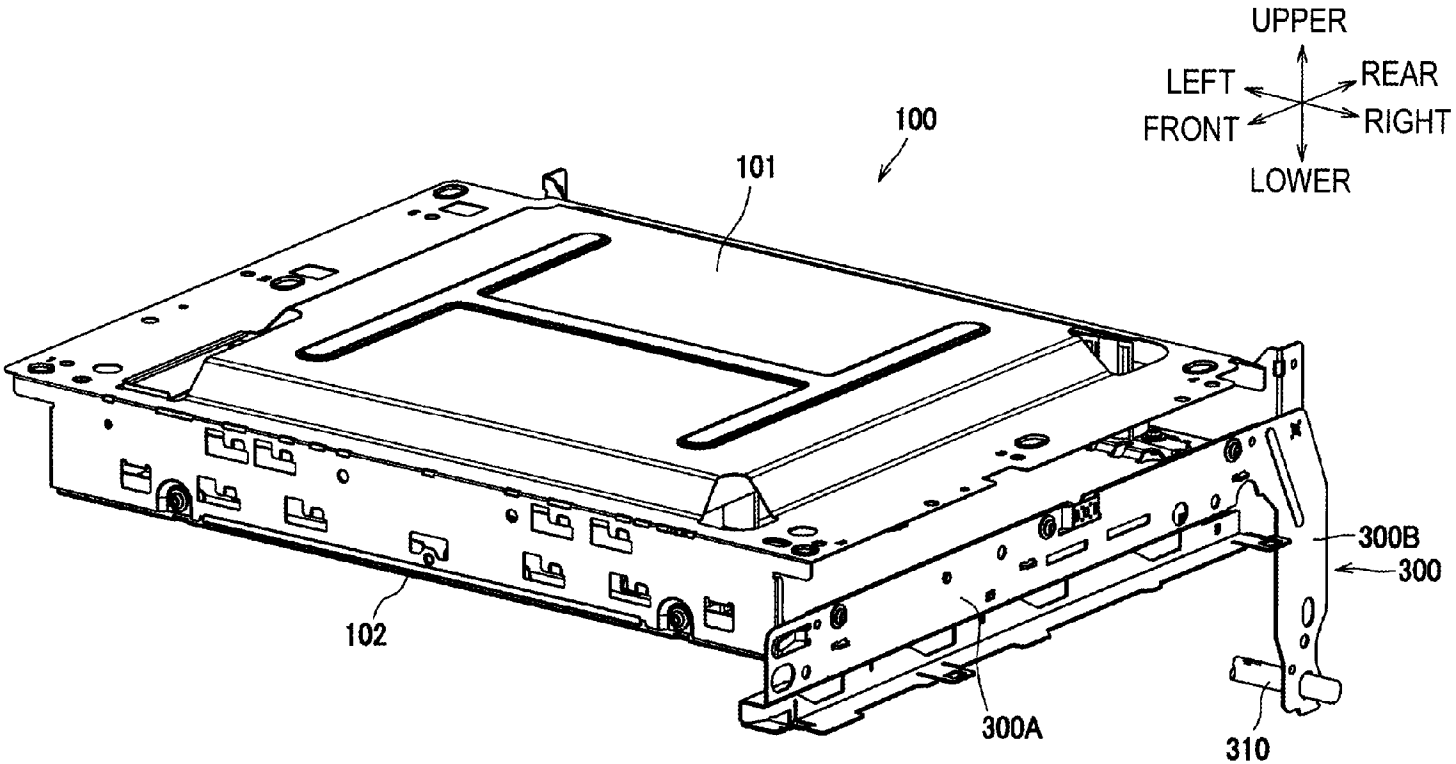
FIG. 4 is a perspective view of a first connection frame and an L-shaped plate as seen in an oblique front-upper direction.

More specifically, as shown in FIGS. 3 and 4, left and right end portions of an upper wall part 101 of the first coupling frame 100 are fixed to upper surfaces of the respective side frames 12, 13 by screws S4 and left and right end portions of a lower wall part 102 thereof are fixed to L-shaped plates 300 fixed to the respective side frames 12, 13. Here, the L-shaped plate 300 has a main body part 300A extending in the front-rear direction and an extension part 300B extending downwardly from the main body part 300A, i.e., extending towards the photosensitive drum 51. The main body part 300A is arranged to overlap with the first coupling frame 100, when projected in the left-right direction. The extension part 300B is configured to support a positioning shaft 310 (refer to FIG. 1) engaged with a rear part of the drawer 60 so as to position the drawer 60. The L-shaped plates 300 are fixed to inner sides of the respective side frames 12, 13 in the left-right direction.

As shown in FIGS. 3 and 1, the second coupling frame 200 is a metallic frame and has a cylindrical shape of which a section orthogonal to the left-right direction has a closed sectional shape, and both end portions thereof in the left-right direction are connected to the pair of side frames 12, 13. The second coupling frame 200 is arranged below the plurality of process units 50.

Thereby, since the first coupling frame 100 and the second coupling frame 200 are arranged to hold the plurality of process units 50 therebetween in the upper-lower direction, it is possible to efficiently reinforce central parts (parts overlapping with the plurality of process units 50 in the direction of the rotary axis) of the pair of side frames 12, 13 by the respective coupling frames 100, 200.

Also, a center C2 of the second coupling frame 200 in the front-rear direction is arranged to deviate rearwards with respect to the center C of the side frames 12, 13 in the front-rear direction. In other words, the second coupling frame 200 is arranged to be close to the rear ends of the side frames 12, 13 (i.e., at a position closer to the rear ends of the side frames 12, 13 than the front ends thereof).

That is, considering the relation with the first coupling frame 100, the first coupling frame 100 is arranged to be close to the front ends of the side frames 12, 13 and the second coupling frame 200 is arranged to be close to the rear ends thereof. Thereby, since the first coupling frame 100 and the second coupling frame 200 are arranged on substantial diagonal lines of the side frames 12, 13, it is possible to further increase the stiffness of the pair of side frames 12, 13.

Also, the second coupling frame 200 is formed to have a size extending from a rear end portion of the first coupling frame 100 to the vicinity of the rear ends of the pair of side frames 12, 13. Further, the second coupling frame 200 is arranged to overlap with the first coupling frame 100, when projected in the upper-lower direction.

Thereby, since it is possible to reinforce the pair of side frames 12, 13 over the entire ranges thereof in the front-rear direction by the respective coupling frames 100, 200, it is possible to further increase the stiffness of the pair of side frames 12, 13.

Also, a power supply substrate 400 for supplying power to the process units 50 is accommodated in the second coupling frame 200. A transformer 401, which is an element configuring a power supply circuit, is mounted on the power supply substrate 400. In this way, the power supply substrate 400 is accommodated in the second coupling frame 200 made of metal, so that it is possible to suppress an emission noise, which is generated from the power supply substrate 400, from spreading.

Figure 5:
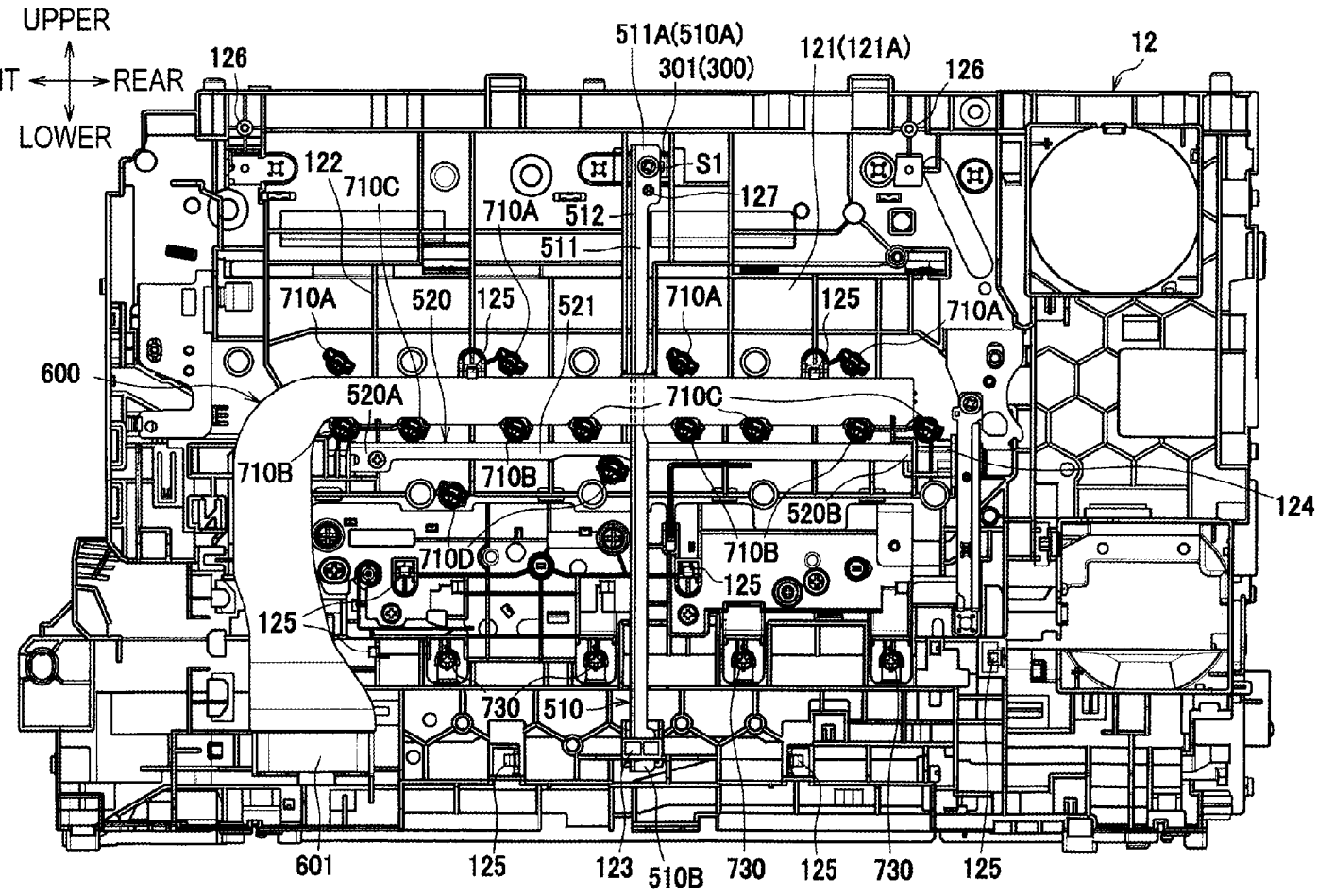
FIG. 5 is a side view of a right side frame, as seen from an outer side in a left-right direction.
Figure 6:
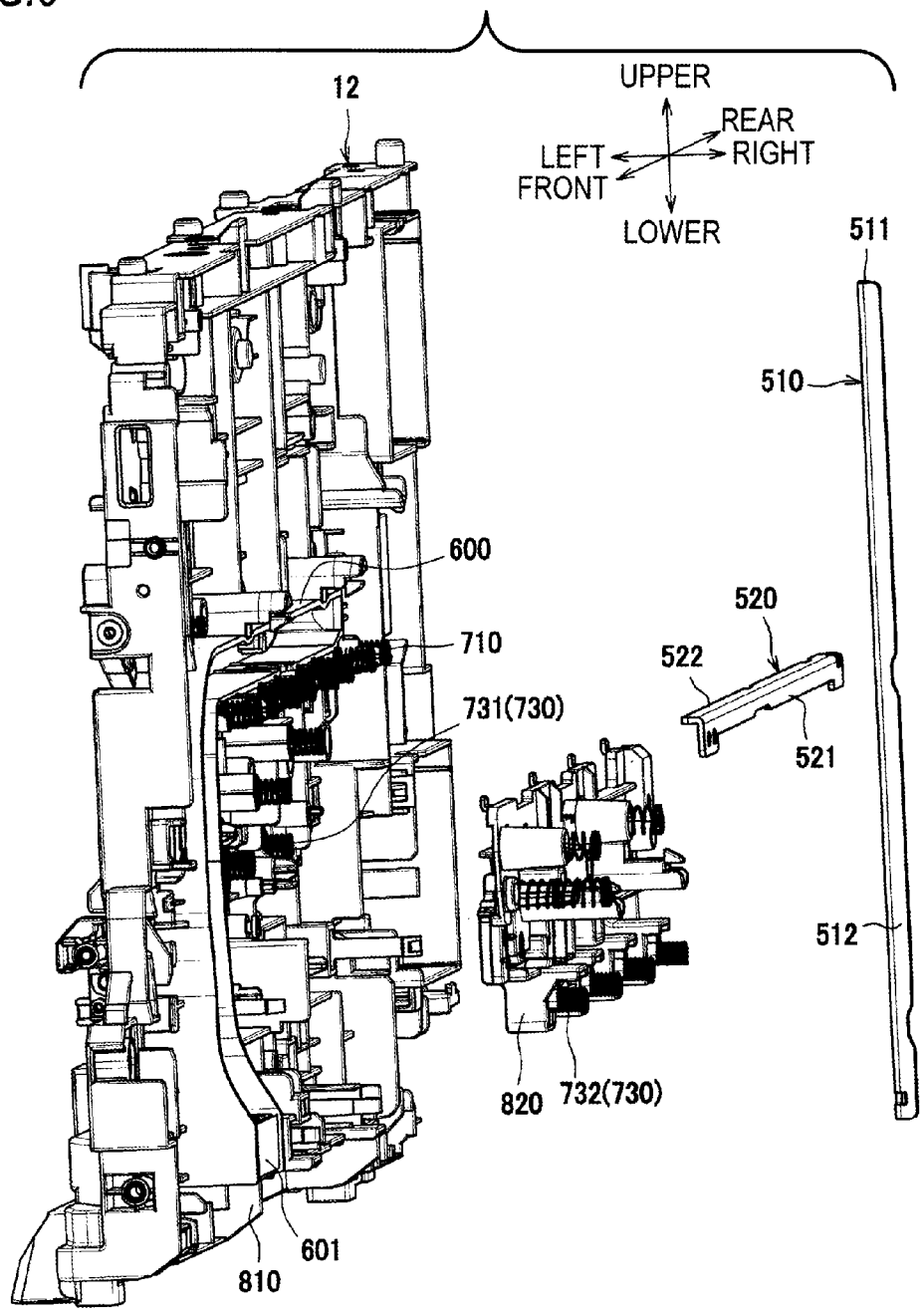
FIG. 6 is an exploded perspective view illustrating a state where a beam-shaped plate and the like are detached from the right side frame.

As shown in FIGS. 5 and 6, the first beam-shaped plate 510 made of metal such as iron is an example of a first beam member, has a long shape extending in the upper-lower direction, is arranged along the plane 121A of the plate-shaped part 121 of the right side frame 12 and is fixed to the right side frame 12 from an outer side in the left-right direction. Thereby, since the right side frame 12 made of resin is reinforced by the first beam-shaped plate 510, it is possible to increase the stiffness of the right side frame 12, as compared to a structure where the right side frame is made of resin only.

A maximum width of the first beam-shaped plate 510 in a width direction is very small, such as about 1/47 of a maximum length of the right side frame 12 in the front-rear direction. Like this, the first beam-shaped plate 510 having the very small width as regards the right side frame 12 made of resin is provided, so that it is possible to lighten the color printer 1, as compared to a structure where the side frame is configured by a large plate, like the related art. In the meantime, the maximum width of the first beam-shaped plate 510 in the width direction is preferably 1/10 to 1/100 of the maximum length of the right side frame 12 in the front-rear direction, more preferably 1/40 to 1/50.

The first beam-shaped plate 510 is arranged to penetrate a duct 600 provided for the right side frame 12 in the upper-lower direction, and an upper end portion 510A thereof is fixed to an upper part of the right side frame 12 and the L-shaped plate 300 and a lower end portion 510B thereof is engaged with a lower part of the right side frame 12. Here, the duct 600 is an air flow path configured to guide air from an air blower 601 to the respective process units 50.

Figure 7:
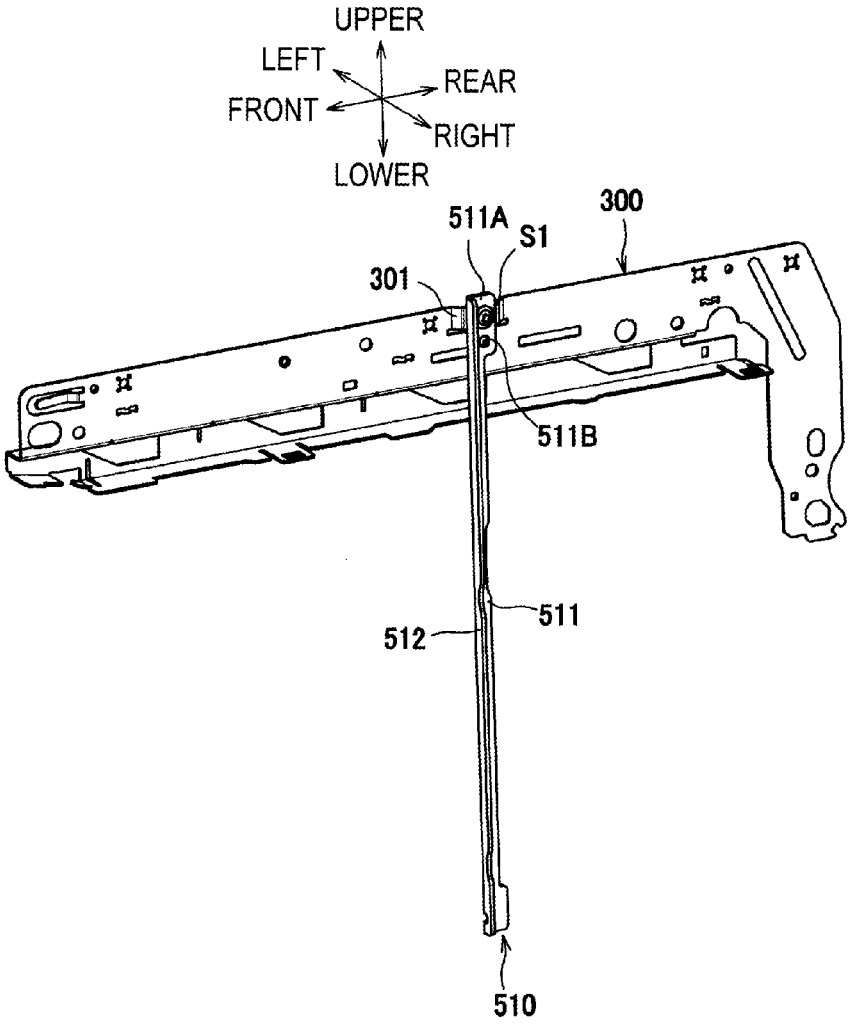
FIG. 7 is a perspective view of the L-shaped plate and a first beam-shaped plate.

As shown in FIG. 7, the first beam-shaped plate 510 is formed by bending a long plate into an L-shape, as viewed from a section, and mainly has a first wall 511 orthogonal to the left-right direction and a second wall 512 extending from a front end of the first wall 511 towards an outer side in the left-right direction. An upper end portion 511A of the first wall 511 is formed with two holes 511B arranged side by side in the upper-lower direction. A screw S1 for fastening the first beam-shaped plate 510 to the L-shaped plate 300 is inserted into the upper hole 511B (not shown).

Specifically, the L-shaped plate 300 is formed with a protrusion 301 protruding outwardly in the left-right direction. As shown in FIGS. 5 and 7, the protrusion 301 is arranged to pass through a through-hole (a reference numeral thereof is omitted) formed in the plate-shaped part 121 of the right side frame 12 and to protrude outwardly beyond the plate-shaped part 121 in the left-right direction. The upper end portion 511A of the first wall 511 of the first beam-shaped plate 510 is set with respect to the protrusion 301 and the screw S1 is inserted into the upper hole 511B of the upper end portion 511A and is engaged with the L-shaped plate 300, so that the upper end portion 511A of the first wall 511 is fixed to the L-shaped plate 300. That is, the right side frame 12 is held between the L-shaped plate 300 arranged at the inner side thereof and the first beam-shaped plate 510 arranged at the outer side thereof.

Also, a boss 127 for positioning the first beam-shaped plate 510 at the right side frame 12 is inserted into the lower hole 511B of the upper end portion 511A of the first wall 511. That is, the boss 127 provided for the right side frame 12 is enabled to pass through the lower hole 511B of the upper end portion 511A, so that the upper end portion 511A of the first wall 511 is positioned with respect to the right side frame 12.

Figure 8A:
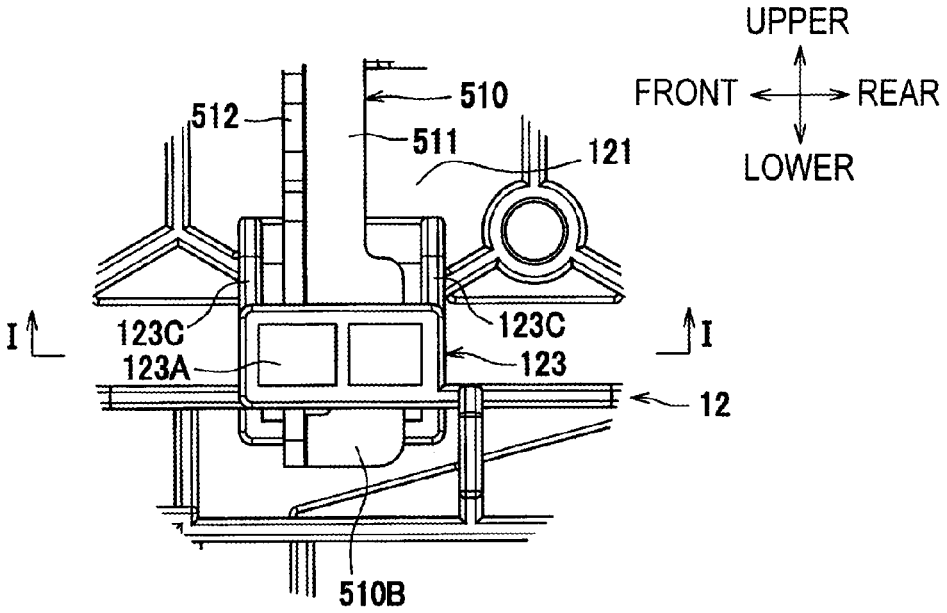
FIG. 8A is an enlarged view illustrating a first engaging part configured to engage with a lower end portion of the first beam-shaped plate.
Figure 8B:
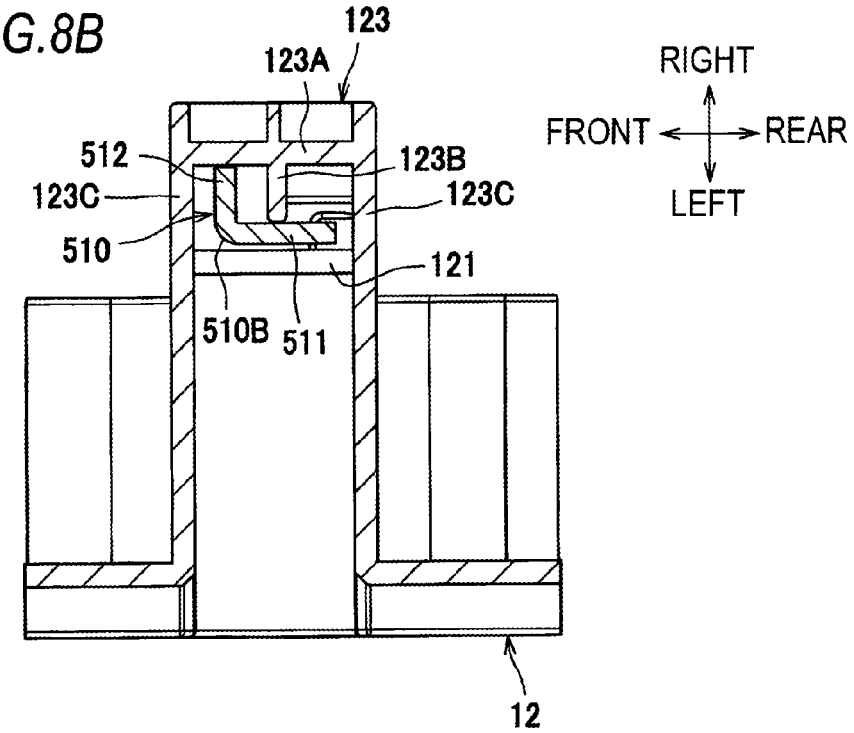
FIG. 8B is a sectional view taken along a line I-I of FIG. 8A.

The lower end portion 510B of the first beam-shaped plate 510 is engaged with a first engaging part 123 formed at the right side frame 12. As shown in FIGS. 8A and 8B, the first engaging part 123 has a first engaging wall 123A arranged at the right (an outer side in the left-right direction) of the second wall 512 of the first beam-shaped plate 510 and engaged with an end surface of the second wall 512, a second engaging wall 123B extending in a left direction (an inner side in the left-right direction) from a center of the first engaging wall 123A in the front-rear direction and engaged with the first wall 511 of the first beam-shaped plate 510, and a pair of connection walls 123C extending leftwards from both front and rear ends of the first engaging wall 123A and connected to the plate-shaped part 121.

The lower end portion 510B of the first beam-shaped plate 510 is arranged between the respective engaging walls 123A, 123B and the plate-shaped part 121 in the left-right direction, so that movement thereof in the left-right direction is restrained by the respective engaging walls 123A, 123B and the plate-shaped part 121. Also, the lower end portion 510B of the first beam-shaped plate 510 is arranged to protrude downwardly beyond the first engaging part 123. Thereby, although the right side frame 12 made of resin has the higher coefficient of thermal expansion than the first beam-shaped plate 510 made of metal, even when the right side frame 12 is thermally expanded, the lower end portion 510B is difficult to separate from the first engaging part 123.

Further, a space is provided below the lower end portion 510B of the first beam-shaped plate 510 engaged with the first engaging part 123, with considering the difference in the coefficient of thermal expansion. Thereby, even when the right side frame 12 is thermally contracted, it is possible to suppress the lower end portion 510B from interfering with other members.

As shown in FIGS. 5 and 6, the second beam-shaped plate 520 is an example of a second beam member, and has substantially the same structure as the first beam-shaped plate 510, specifically a first wall 521 and a second wall 522 having substantially the same structures as the first wall 511 and the second wall 512 of the first beam-shaped plate 510. The second beam-shaped plate 520 is arranged at an inner side of the first beam-shaped plate 510 in the left-right direction, and is fixed to the right side frame 12 along the front-rear direction so that it is orthogonal to the first beam-shaped plate 510. Specifically, the second beam-shaped plate 520 and the first beam-shaped plate 510 are arranged to intersect with each other in a cross shape so that central parts thereof overlap with each other, as seen in the left-right direction. Thereby, it is possible to further increase the stiffness of the right side frame 12 by the two intersecting beam-shaped plates 510, 520.

The second beam-shaped plate 520 is arranged so that the first wall 521 thereof is perpendicular to the left-right direction, specifically, is arranged along the plane 121A of the plate-shaped part 121 of the right side frame 12, and is arranged with a tip of the second wall 522 facing towards an inner side in the left-right direction. That is, the tips of the second walls 512, 522 of the respective beam-shaped plates 510, 520 are arranged to face in an opposite direction, so that the surfaces of the first walls 511, 521 can be closely contacted to each other. Therefore, it is possible to suppress the deformation of the second beam-shaped plate 520 by strongly holding the second beam-shaped plate 520 between the first beam-shaped plate 510 and the right side frame 12.

Figure 9A:
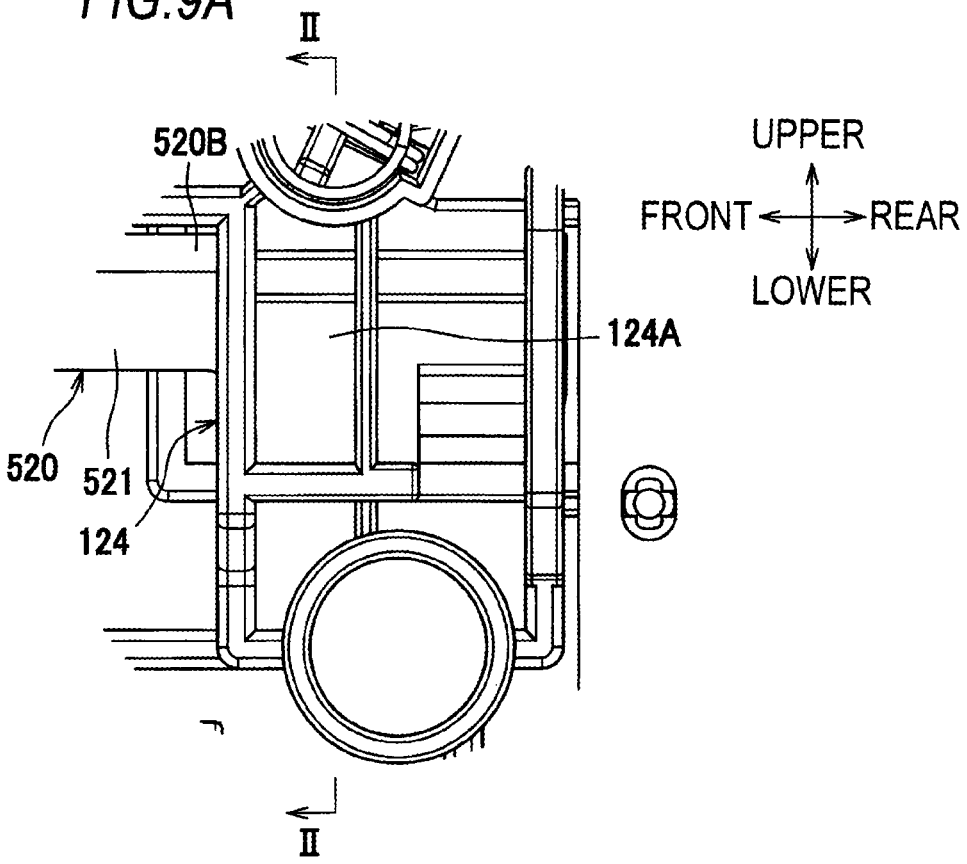
FIG. 9A is an enlarged view illustrating a second engaging part configured to engage with a rear end portion of a second beam-shaped plate.
Figure 9B:
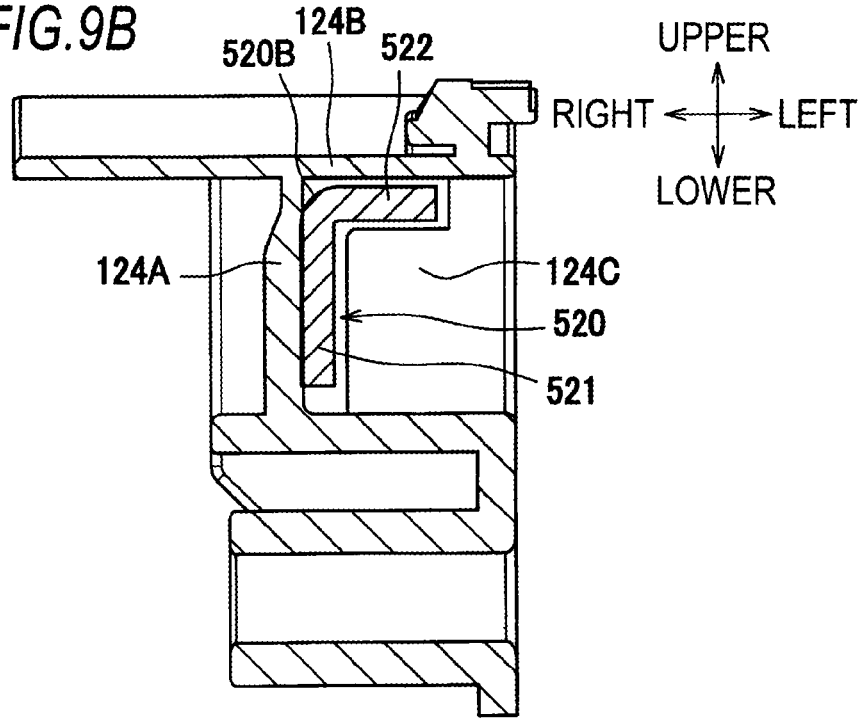
FIG. 9B is a sectional view taken along a line II-II of FIG. 9A.

A front end portion 520A of the second beam-shaped plate 520 is fixed to the right side frame 12 and a rear end portion 520B thereof is engaged with a second engaging part 124 formed at the right side frame 12. As shown in FIGS. 9A and 9B, the second engaging part 124 has a first restraint wall 124A arranged at the right (an outer side in the left-right direction) of the second beam-shaped plate 520, a second restraint wall 124B arranged at an upper side of the second beam-shaped plate 520, and a third restraint wall 124C arranged at the left (an inner side in the left-right direction) of the second beam-shaped plate 520.

A right end edge of the third restraint wall 124C has a shape along with the second beam-shaped plate 520. Thereby, the second beam-shaped plate 520 is restrained from moving in the left-right direction by the first restraint wall 124A and the third restraint wall 124C, and the second beam-shaped plate 520 is restrained from moving in a vertical direction of the second wall 522 between the second restraint wall 124B and the third restraint wall 124C.

Also, a space is provided at the rear of the rear end portion 520B of the second beam-shaped plate 520 engaged with the second engaging part 124, with considering the difference in the coefficient of thermal expansion. Thereby, it is possible to handle the difference in the coefficient of thermal expansion between the second beam-shaped plate 520 and the right side frame 12 made of resin. Specifically, even when the right side frame 12 is thermally contracted, it is possible to suppress the rear end portion 520B from interfering with the other members.

In the below, the arrangements of the first beam-shaped plate 510 and the second beam-shaped plate 520 and the like are described in more detail.

Figure 10:
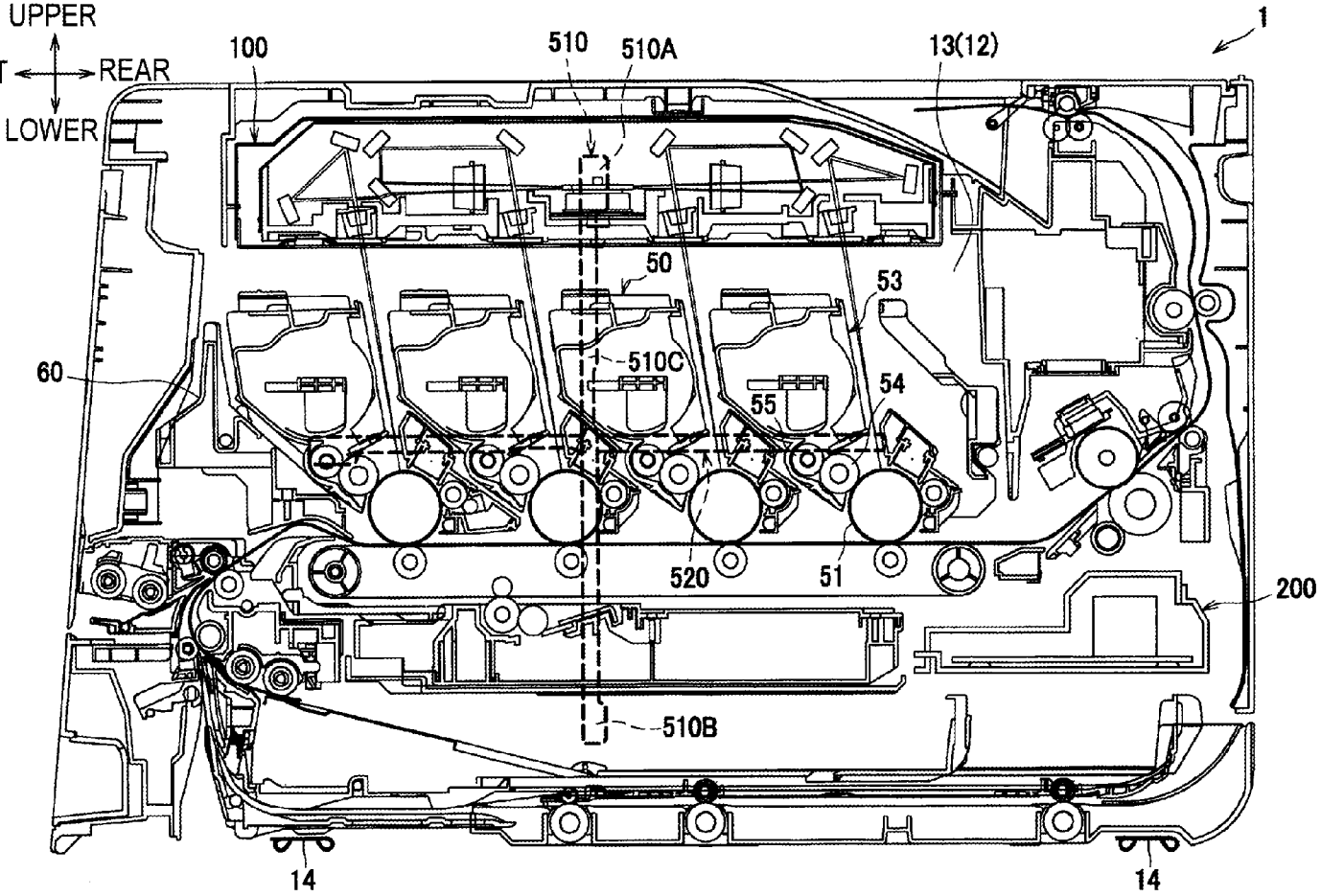

As shown in FIG. 10, the first beam-shaped plate 510 is configured so that a central part 510C thereof in the longitudinal direction overlaps with the process unit 50, when projected in the left-right direction, and the upper end portion 510A and the lower end portion 510B are arranged at outer sides of the process unit 50 in the upper-lower direction. Thereby, it is possible to favorably receive a force applied to the right side frame 12 from the process unit 50, specifically a force applied to a part of the right side frame 12 supporting the drawer 60 by the first beam-shaped plate 510.

The upper end portion 510A of the first beam-shaped plate 510 is arranged to overlap with the first coupling frame 100, when projected in the left-right direction. Thereby, since it is possible to suppress the upper end portion 510A of the first beam-shaped plate 510 from being deformed in the left-right direction by the first coupling frame 100, it is possible to further increase the stiffness of the right side frame 12.

In other words, the upper end portion 510A of the first beam-shaped plate 510 is fixed to a part of the right side frame 12 having the high stiffness (a connection part with the first coupling frame 100). Thereby, since the second beam-shaped plate 520 is pressed from an outer side in the left-right direction by the first beam-shaped plate 510, which is fixed to the part having the high stiffness and is difficult to be deformed, it is possible to favorably suppress the deformation of the second beam-shaped plate 520 by the first beam-shaped plate 510 and to further increase the stiffness of the right side frame 12.

Also, the second beam-shaped plate 520 is arranged to overlap with the drawer 60, when projected in the left-right direction. Here, when the drawer 60 moveably supported to the respective side frames 12, 13 is provided, it is not possible to provide the connection frames 100, 200 configured to connect and reinforce the respective side frames 12, 13 in a moving area of the drawer 60, so as to move the drawer 60. In contrast, the second beam-shaped plate 520 is arranged to overlap with the drawer 60, when projected in the left-right direction, so that it is possible to reinforce the part of the right side frame 12 corresponding to the moving area of the drawer 60 by the second beam-shaped plate 520 even when the connection frames 100, 200 are not provided in the moving area of the drawer 60.

Also, the first beam-shaped plate 510 is formed to be thicker than a thickness 1.6 mm of the second beam-shaped plate 520, for example, and is made of a material such as stainless steel having higher stiffness than iron, so that the stiffness thereof is higher than the second beam-shaped plate 520. Here, the 'stiffness of the beam-shaped plate' means a difficulty of deformation of the beam-shaped plate. For example, it is possible to determine whether the stiffness is high or low on the basis of bending amounts of the respective beam-shaped plates 510, 520, which are obtained by applying the same load to the first beam-shaped plate 510 and the second beam-shaped plate 520.

Thereby, when the high load is applied to the color printer 1, for example, when the color printer 1 is dropped from a high position, even though the drawer 60 is pressed towards the right side frame 12 and the right side frame 12 is thus deformed around the second beam-shaped plate 520, the deformation can be suppressed by the first beam-shaped plate 510 having the higher stiffness than the second beam-shaped plate 520.

Also, as described above, the first beam-shaped plate 510 having the high stiffness is arranged to contact the second beam-shaped plate 520 at the opposite side to the plurality of process units 50 with respect to the second beam-shaped plate 520. Thereby, when the high load is applied to the right side frame 12 from the plurality of process units 50, for example, when the color printer 1 is dropped from the high position, the load from the plurality of process units 50 is collectively received by the second beam-shaped plate 520 extending in the arrangement direction of the plurality of process units 50 and then by the first beam-shaped plate 510 having the higher stiffness than the second beam-shaped plate 520. Therefore, it is possible to effectively receive the load by the respective beam-shaped plates 510, 520, thereby effectively suppressing the deformation of the right side frame 12.

Figure 11:
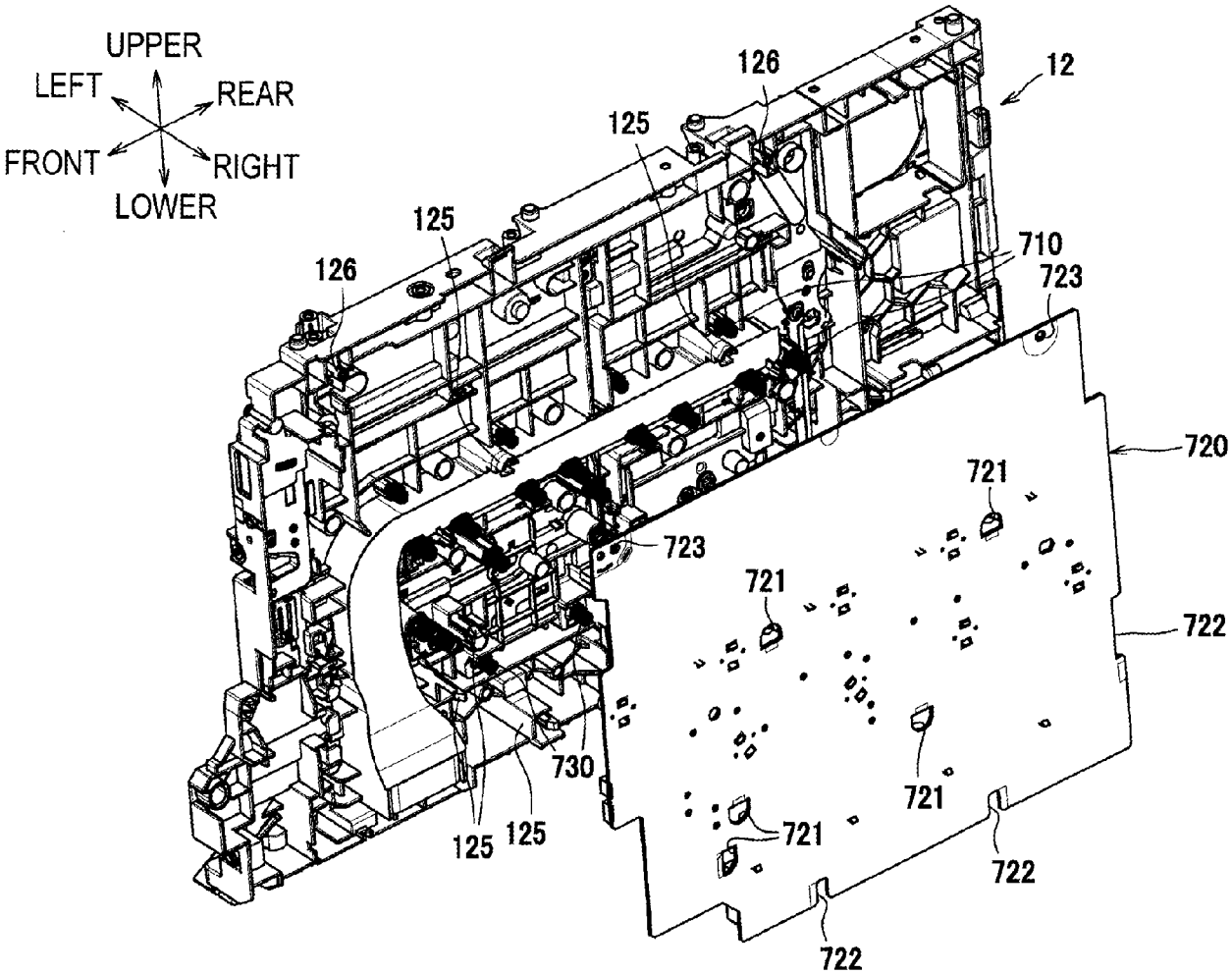
FIG. 11 is an exploded perspective view illustrating spring-shaped electrodes and a substrate.

As shown in FIG. 11, the right side frame 12 reinforced by the respective beam-shaped plates 510, 520 is applied with urging forces of a plurality of spring-shaped electrodes 710 for supplying power to the plurality of process units 50 and a plurality of spring-shaped electrodes 730 for supplying power to the transfer unit 70. Specifically, an outer side in the left-right direction the right side frame 12 is provided with a substrate 720 for converting power fed from the power supply substrate 400 (refer to FIG. 1) into appropriate power and supplying the same to the plurality of process units 50 and the transfer unit 70 through the plurality of spring-shaped electrodes 710, 730. In this way, the substrate 720 is provided at the outer side of the right side frame 12 in the left-right direction, so that it is possible to suppress the drawer 60 from interfering with the substrate 720 upon the mounting and demounting of the drawer 60.

The right side frame 12 is provided with a plurality of support parts 125, 126 configured to support the substrate 720 at the outer side in the left-right direction (the opposite side to the process units 50) (refer to FIG. 5). The support parts 125 are configured to support the substrate 720 by engaging elastically deformable claws (the reference numerals thereof are omitted) with holes 721 or notched portions 722 formed on the substrate 720 in the direction orthogonal to the left-right direction. The support parts 126 are parts to which screws (not shown) penetrating through-holes 723 formed at an upper end of the substrate 720 are engaged, and are configured to support the substrate 720 by the corresponding engagement.

Figure 12:
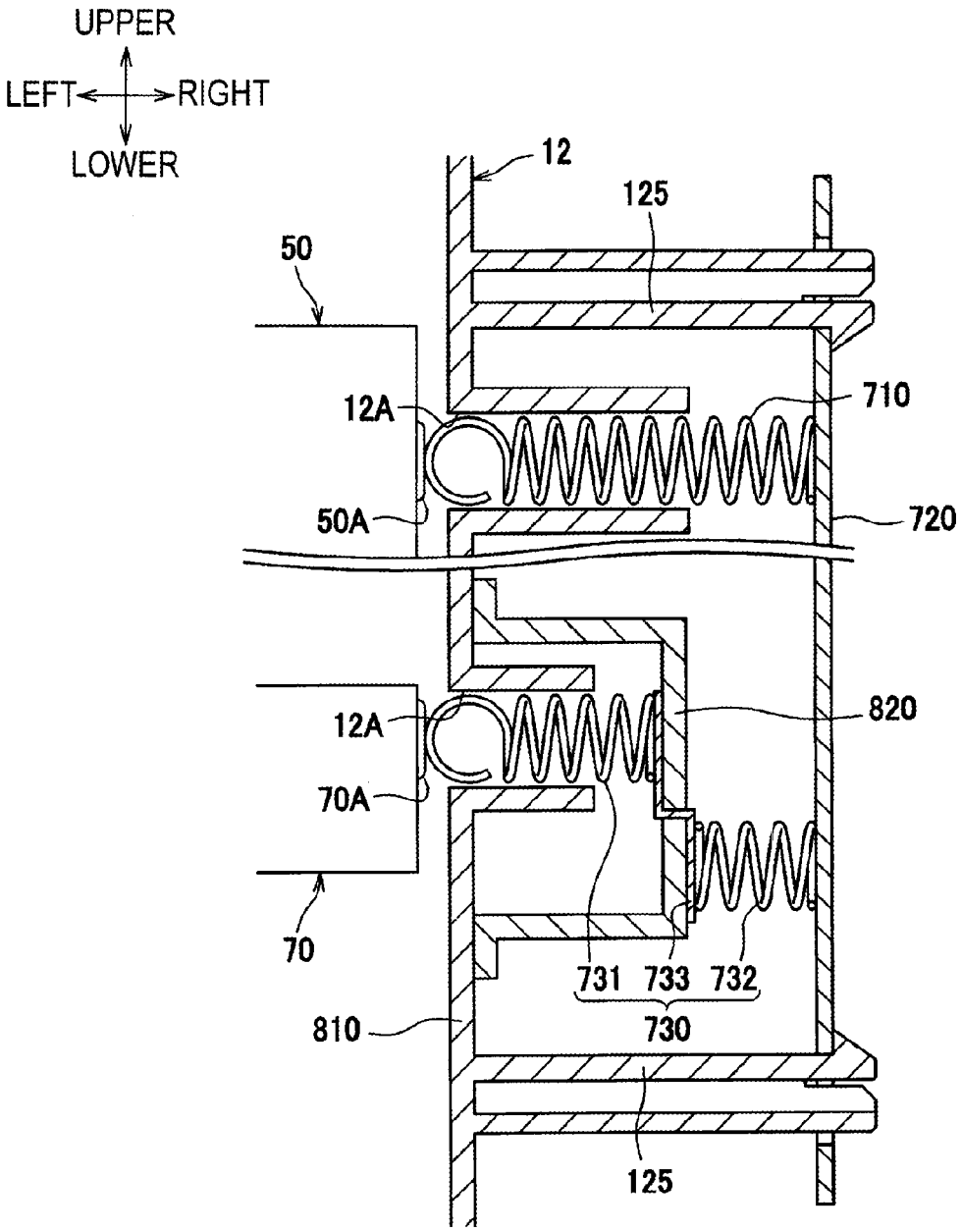
FIG. 12 is a sectional view schematically illustrating a structure around the spring-shaped electrode.

As schematically shown in FIG. 12, the spring-shaped electrode 710 arranged at the upper side is an electrode having a compression coil spring, is supported to the right side frame 12 and is contacted to an electrode 50A of the process unit 50 with being compressed between the substrate 720 and the electrode 50A. Meanwhile, in this illustrative embodiment, the spring-shaped electrode 710 is directly connected to the electrode 50A of the process unit 50. However, this disclosure is not limited thereto. For example, the spring-shaped electrode 710 may be indirectly connected to the electrode of the process unit 50 via a conductor for relay provided for the drawer.

Also, the spring-shaped electrode 730 arranged at the lower side has a first spring-shaped electrode 731 connected to an electrode 70A of the transfer unit 70, a second spring-shaped electrode 732 connected to the substrate 720 and a relay conductor 733 connected to the first spring-shaped electrode 731 and the second spring-shaped electrode 732.

The first spring-shaped electrode 731 is an electrode having a compression coil spring, is supported to the right side frame 12 and is contacted to the electrode 70A of the transfer unit 70 with being compressed between the right side frame 12 and the electrode 70A of the transfer unit 70. Specifically, the right side frame 12 has a main frame 810 and a sub-frame 820 fixed to an outer side of the main frame 810 (refer to FIG. 6), and the first spring-shaped electrode 731 is arranged between the transfer unit 70 and the sub-frame 820.

The relay conductor 733 is provided to penetrate the sub-frame 820 outwardly from an inner side in the left-right direction.

The second spring-shaped electrode 732 is an electrode having a compression coil spring, is supported to the sub-frame 820 and is provided with being compressed between the relay conductor 733 and the substrate 720.

The spring-shaped electrodes 710, 730 are provided in this way, so that it is possible to securely connect the spring-shaped electrodes 710, 730 to the process units 50, the transfer unit 70 and the substrate 720 and to suppress the process units 50 from moving in the left-right direction with respect to the right side frame 12 by the urging forces of the spring-shaped electrodes 710, 730. Also in the configuration where the urging forces of the spring-shaped electrodes 710, 730 are applied to the right side frame 12, the right side frame 12 is reinforced by the respective beam-shaped plates 510, 520, so that it is possible to increase the stiffness of the right side frame 12, thereby suppressing the deformation thereof.

Also, the right side frame 12 is formed with a plurality of through-holes 12A for supporting the respective spring-shaped electrodes 710, 730 with being inserted therein. Like this, even when the right side frame 12 is formed with the plurality of through-holes 12A, which lowers the strength of the right side frame 12, the right side frame 12 is reinforced by the respective beam-shaped plates 510, 520, so that it is possible to suppress the deformation of the right side frame 12.

In the meantime, as shown in FIG. 5, the plurality of spring-shaped electrodes 710 includes four electrodes 710A for wire, four electrodes 710B for developing, four electrodes 710C for grid and two electrodes 710D for drum. The respective electrodes 710A for wire are electrodes for supplying power to the respective charging wires 52A, are provided in correspondence to the respective charging wires 52A and are arranged side by side at the same pitch in the front-rear direction.

The respective electrodes 710B for developing are electrodes for supplying power (developing biases) to the respective developing cartridges 53, are provided in correspondence to the respective developing cartridges 53 and are arranged side by side at the same pitch in the front-rear direction. More specifically, the respective electrodes 710B for developing are configured to supply the power to the developing rollers 54 and supply rollers 55 of the respective developing cartridges 53. The respective electrodes 710C for grid are electrodes for supplying power to the respective grid electrodes 52B, are provided in correspondence to the respective grid electrodes 52B and are arranged side by side at the same pitch in the front-rear direction. The respective electrodes 710D for drum are electrodes for supplying power to the respective photosensitive drums 51 and are arranged below the plurality of electrodes 710C for grid.

Also, the plurality of spring-shaped electrodes 730 are electrodes for supplying power (transfer biases) to the respective transfer rollers 74, are provided in correspondence to the respective transfer rollers 74 and are arranged side by side at the same pitch in the front-rear direction. The first beam-shaped plate 510 is arranged between the two same target electrodes at the center of the four same target electrodes (for example, the electrodes 710A for wire), which have the same power supplying targets.

Figure 13:
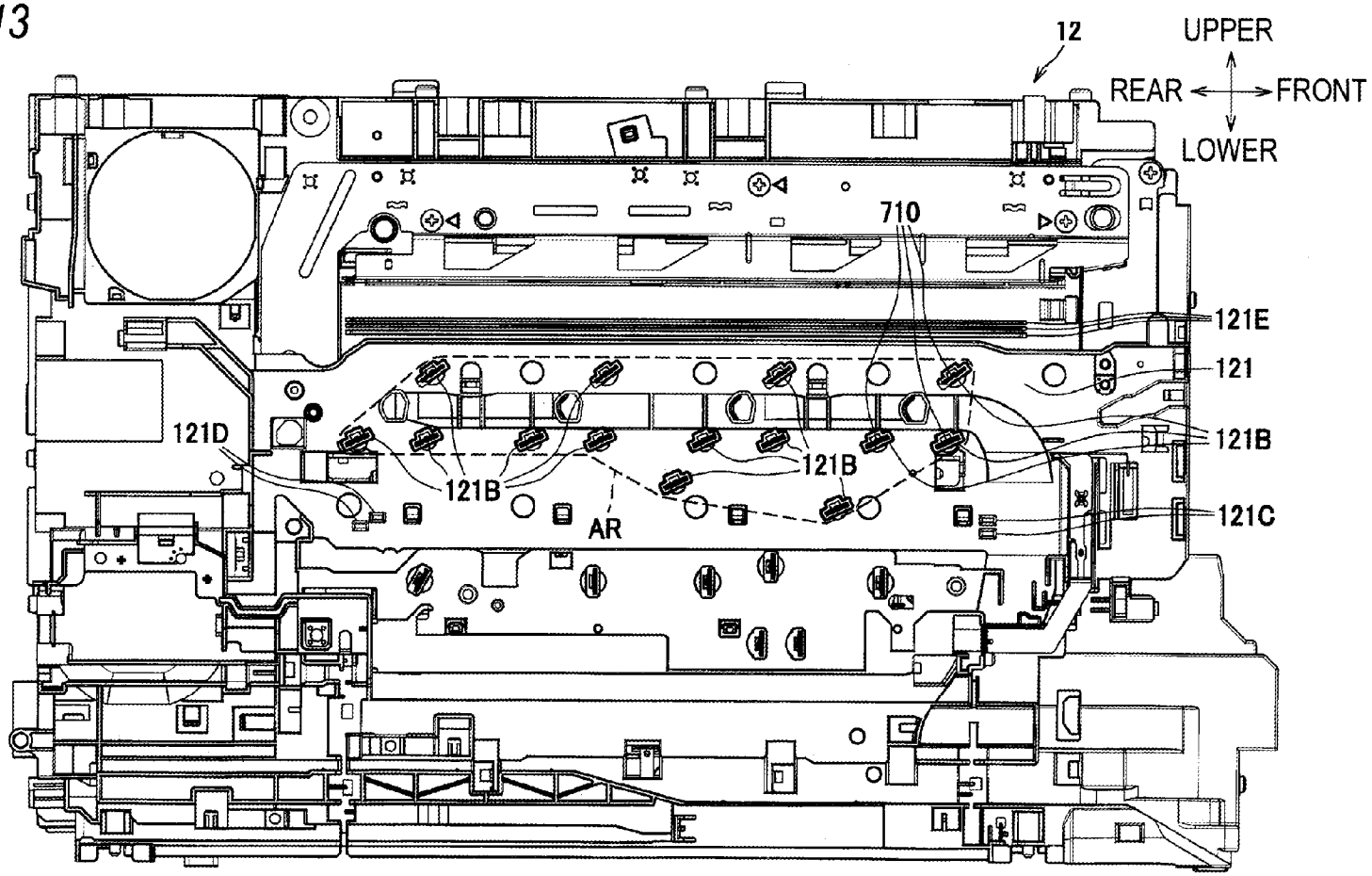
FIG. 13 is a side view of the right side frame, as seen from an inner side in the left-right direction.
Figure 14:
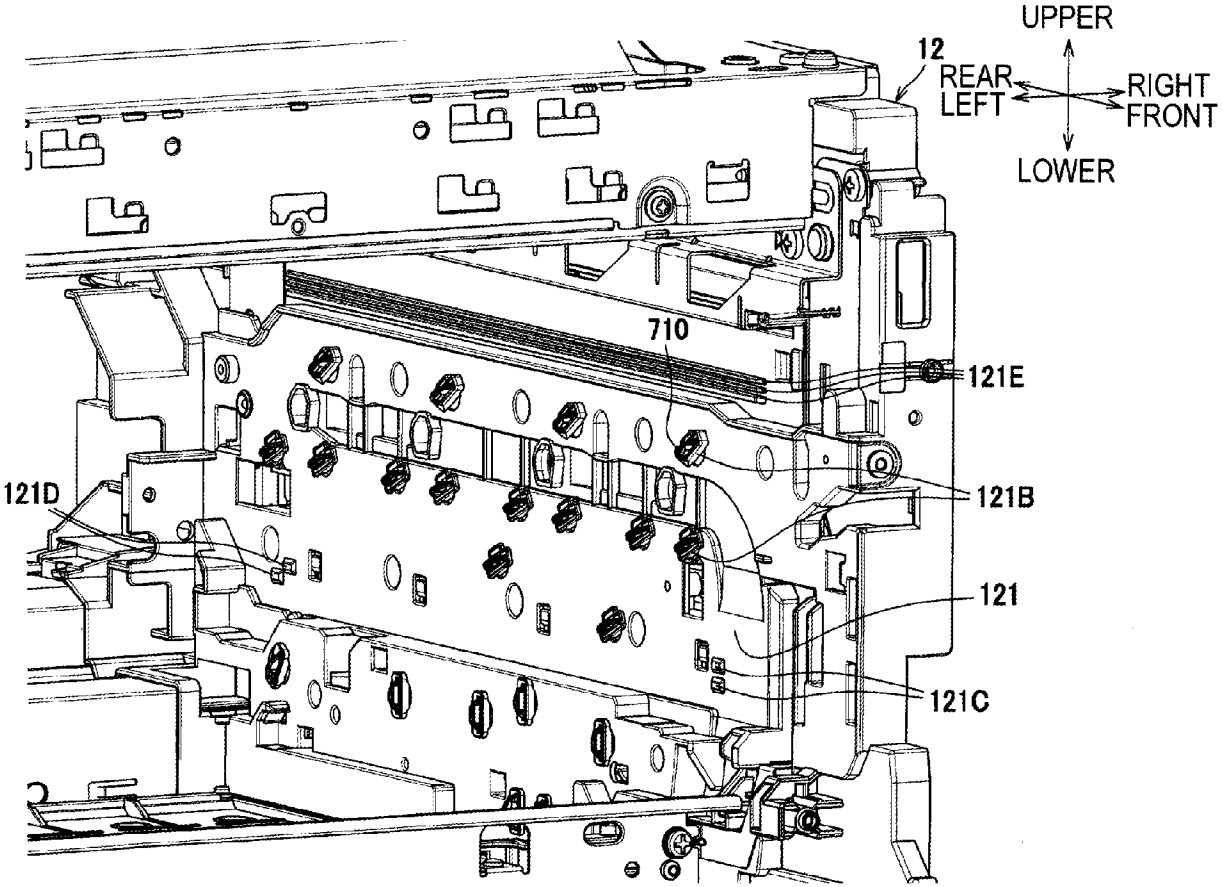
FIG. 14 is a perspective view of the right side frame, as seen from an inner side in the left-right direction.

As shown in FIGS. 13 and 14, the inner surface of the right side frame 12 is provided with a plurality of support projections 121B protruding inwardly from the inner surface of the plate-shaped part 121 and configured to support the plurality of spring-shaped electrodes 710, and first projection parts 121C, second projection parts 121D and third projection parts 121E capable of contacting the drawer 60 when the drawer 60 is moved towards the right side frame 12. That is, when the drawer 60 is moved towards the right side frame 12, parts of the right side frame 12 to which the drawer 60 is first contacted are the respective projection parts 121C, 121D, 121E, and the other parts are contacted to the drawer 60 at the same or later timing as or than the respective projection parts 121C, 121D, 121E.

The first projection parts 121C, the second projection parts 121D and the third projection parts 121E are arranged at outer positions of the plurality of support projections 121B, at which they overlap with the drawer 60, as viewed from the left-right direction. Specifically, the respective projection parts 121C, 121D, 121E are arranged at the outer sides of an area AR surrounding the plurality of support projections 121B, which is shown with the broken line. Here, the surrounding area AR is an area connecting outer peripheries of the plurality of support projections 121B with straight lines. In other words, the surrounding area AR is an area surrounded by the straight lines contacting the outer peripheries of the plurality of support projections 121B and lines along the outer peripheries of the support projections 121B.

The two first protrusions 121C are provided to be lined in the upper-lower direction and are respectively arranged at a front-lower position obliquely spaced from the surrounding area AR. That is, the respective first projection parts 121C are arranged at the front of the plurality of support projections 121B in the front-rear direction, specifically, are arranged to be closer to the front end portion of the right side frame 12. Thereby, when the color printer 1 is dropped, for example, and the drawer 60 is thus moved towards the right side frame 12 and is contacted to the first projection parts 121C, the load transmitted from the drawer 60 to the right side frame 12 is transmitted to the front end portion of the right side frame 12, which is relatively difficult to be deformed. For this reason, it is possible to suppress the right side frame 12 made of resin from being deformed, as compared to a structure where the load is transmitted from the drawer to the central part of the right side frame when the color printer is dropped, for example.

Also, the first projection parts 121C are arranged at the above-described position, so that the first projection parts 121C can be contacted to the front end portion of the drawer 60 in the left-right direction. Thereby, since it is possible to bring the first projection parts 121C closer to the front end portion of the right side frame 12, as compared to a structure where the first projection parts are arranged at a position at which they can be contacted to a part closer to the central part of the drawer than the front end portion thereof, it is possible to further suppress the deformation of the right side frame 12.

Two of the second projection parts 121D are arranged to be obliquely lined in a front-upper direction, are spaced downwardly from a rear part of the surrounding area AR and are configured to be contactable to the rear end portion of the drawer 60 in the left-right direction. That is, the first projection parts 121C and the second projection parts 121D are arranged at the positions at which they can be contacted to both end portions of the drawer 60 in the front-rear direction. Thereby, since it is possible to disperse the load, which is applied from the drawer 60, from both end portions of the drawer 60 in the front-rear direction to the right side frame 12 through the respective projection parts 121C, 121D, it is possible to further suppress the deformation of the right side frame 12.

The three third projection parts 121E are provided to be lined in the upper-lower direction, are spaced upwardly from the surrounding area AR and are configured to be contactable to the upper end portion of the drawer 60 in the left-right direction. Thereby, since it is possible to disperse the load from the drawer 60 to the respective projection parts 121C to 121E, it is possible to further suppress the deformation of the right side frame 12.

Also, each of the third projection part 121E is an example of a first rib and is formed to have a long rib shape extending in the front-rear direction. Thereby, since it is possible to disperse the load from the drawer 60 to the third projection parts 121E having the long rib shape, it is possible to favorably suppress the deformation of the right side frame 12.

In the meantime, a length of the third projection part 121E in the front-rear direction may be 254.2 mm, for example.

Figure 15A:
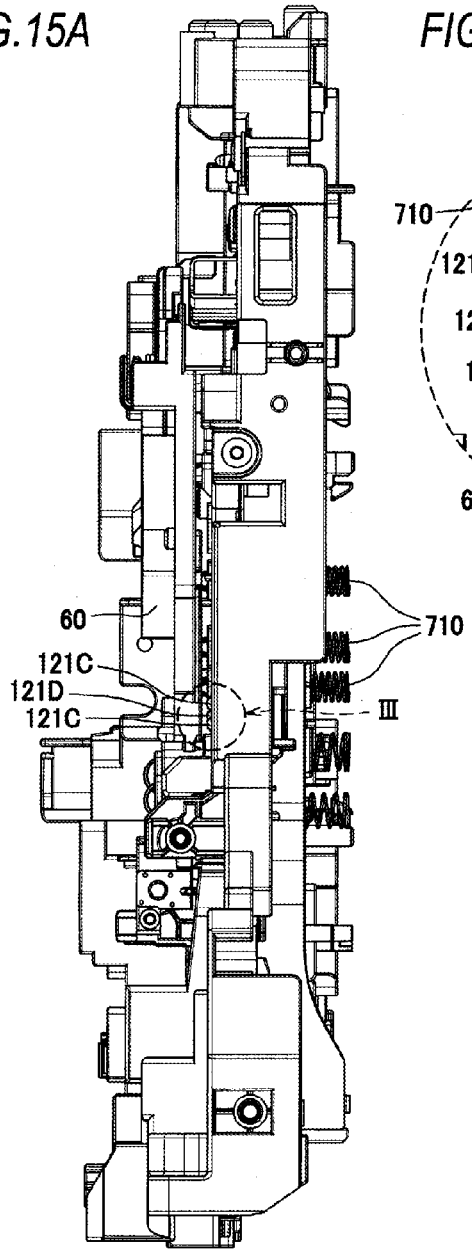
FIG. 15A is a front view of the right side frame, as seen from a front side.
Figure 15B:
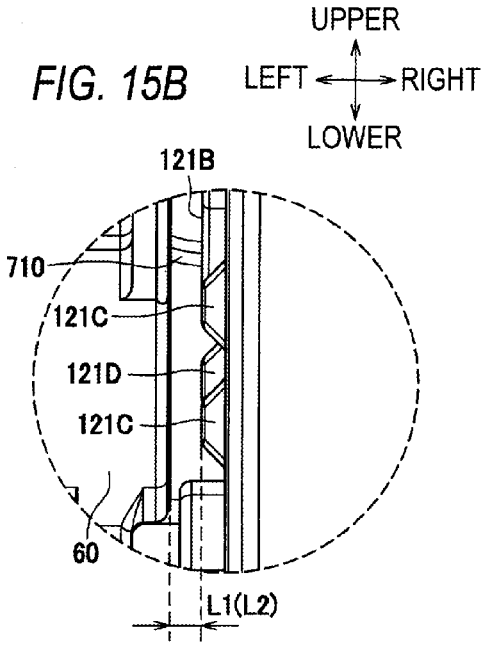
FIG. 15B is an enlarged view of a part denoted with an arrow III in FIG. 15A.

As shown in FIGS. 15A and 15B, inner end surfaces of the respective projection parts 121C to 121E (the third projection parts 121E are not shown) in the left-right direction are located at the same positions as inner end surfaces of the respective support projections 121B in the left-right direction. In other words, a first interval L1 in the left-right direction between the respective projection parts 121C to 121E and the drawer 60 is the same as second interval L2 in the left-right direction between the respective support projections 121B and the drawer 60, for example, 1.3 mm.

Thereby, since it is possible to disperse the load from the drawer 60 to the respective projection parts 121C to 121E and the respective support projections 121B when the image forming apparatus is dropped, for example, it is possible to suppress the deformation of the right side frame 12. In particular, the drawer 60 is configured to be long in the front-rear direction, as compared to the upper-lower direction, and is contacted to the projection parts such as the first projection parts 121C, which are provided at the closer side to the edge of the right side frame 12 than the support projections 121B. For this reason, the drawer 60 is not contacted to only the support projections 121B and the stress concentration on the central part of the right side frame 12 is thus suppressed, so that the right side frame 12 can reduce an amount of strain thereof.

In the meantime, this disclosure is not limited to the above illustrative embodiment. For example, the first interval in the left-right direction between the respective projection parts 121C to 121E and the drawer 60 may be smaller than the second interval in the left-right direction between the respective support projections 121B and the drawer 60. Also in this case, since the respective projection parts 121C to 121E are earlier contacted to the drawer 60 than the respective support projections 121B and the load from the drawer 60 can be transmitted to the end portion-side of the right side frame 12, which is difficult to be deformed, it is possible to suppress the deformation of the right side frame 12.

Meanwhile, the first interval in the left-right direction between the respective projection parts 121C to 121E and the drawer 60 may be 1.3 mm, for example.

According to the above illustrative embodiment, it is also possible to accomplish following effects, in addition to the above-described effects.

The respective beam-shaped plates 510, 520 have the first walls 511, 521 orthogonal to the left-right direction, so that it is possible to stably attach the respective beam-shaped plates 510, 520 to the right side frame 12 by the respective first walls 511, 521. Also, since it is possible to increase the stiffness of the first walls 511, 521 by the second walls 512, 522, it is possible to increase the stiffness of the respective beam-shaped plates 510, 520.

In the meantime, this disclosure is not limited to the above illustrative embodiment and can be used in various forms, as described below. In the below descriptions, the substantially same constitutional elements as those of the above illustrative embodiment are denoted with the same reference numerals and the descriptions thereof are omitted.

Figure 16:
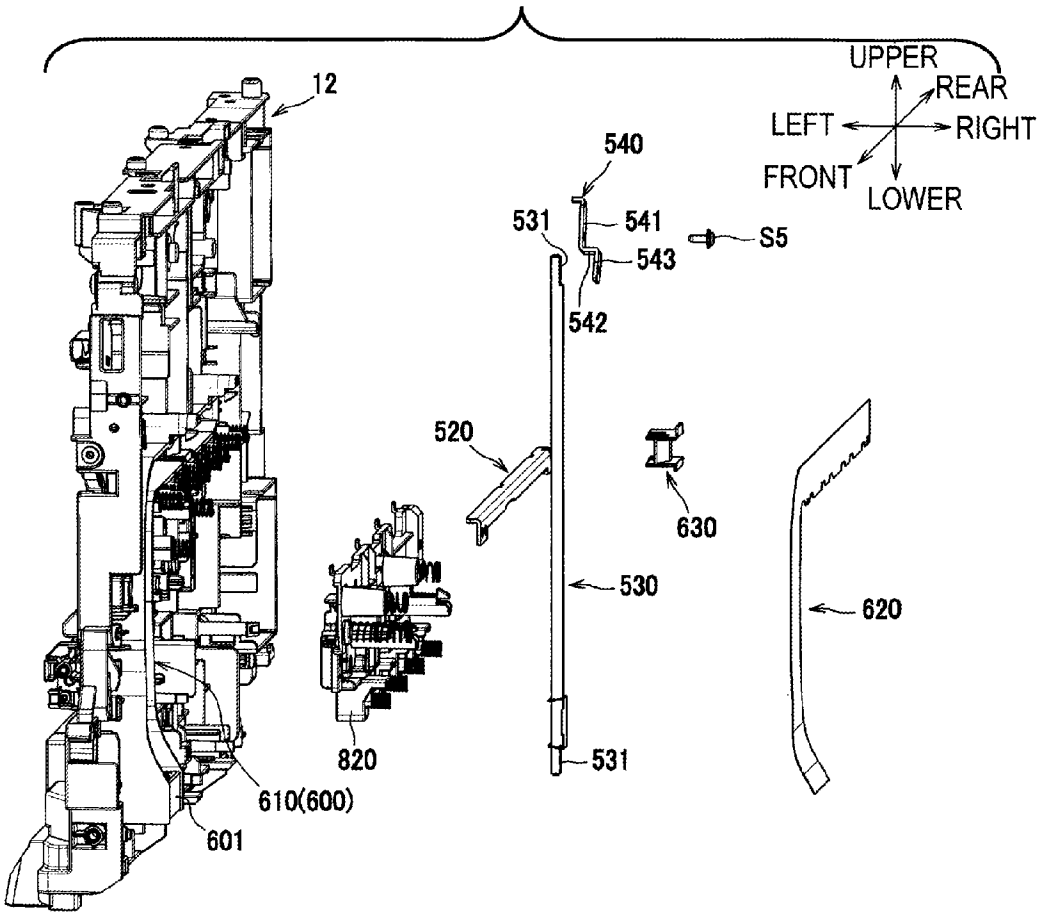
FIG. 16 is an exploded perspective view illustrating a state where a first beam member and the like are detached from the right side frame according to another illustrative embodiment.
Figure 17:
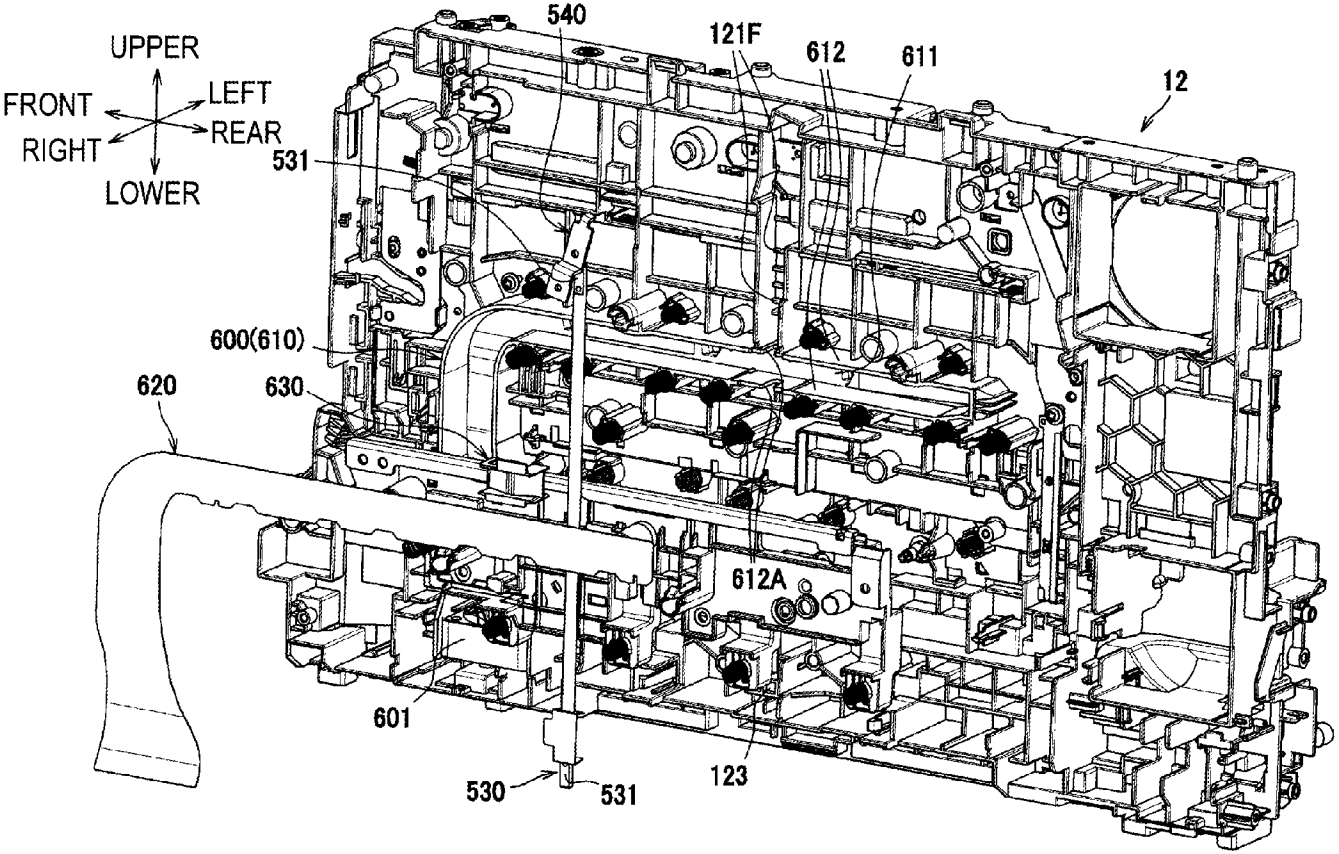
FIG. 17 is an exploded perspective view illustrating a state where the first beam member and the like are detached from the right side frame according to the illustrative embodiment of FIG. 16.

In the above illustrative embodiment, the first beam member is configured by the plate (the first beam-shaped plate 510). However, this disclosure is not limited thereto. For example, as shown in FIGS. 16 and 17, a first beam member 530 may have a cylindrical shape. According to this configuration, it is possible to make the first beam member 530 compact while increasing the stiffness of the first beam member 530.

Specifically, in this configuration, the first beam member 530 has first plane parts 531 along a longitudinal direction at both end portions thereof, which are formed by partially cutting both end portions of a cylindrical metal rod. The first beam member 530 is engaged at a lower end portion thereof with the substantially same first engaging part 123 as the above illustrative embodiment, and an upper end portion thereof is held between a metallic plate-shaped member 540, which is an example of an elastic member, and the right side frame 12.

In the meantime, a diameter of the first beam member 530 may be 5 mm, for example, and a maximum thickness (a length in a direction orthogonal to the first plane part 531) of the end portion at which the first plane part 531 is formed may be 3.8 mm, for example.

Figure 18:
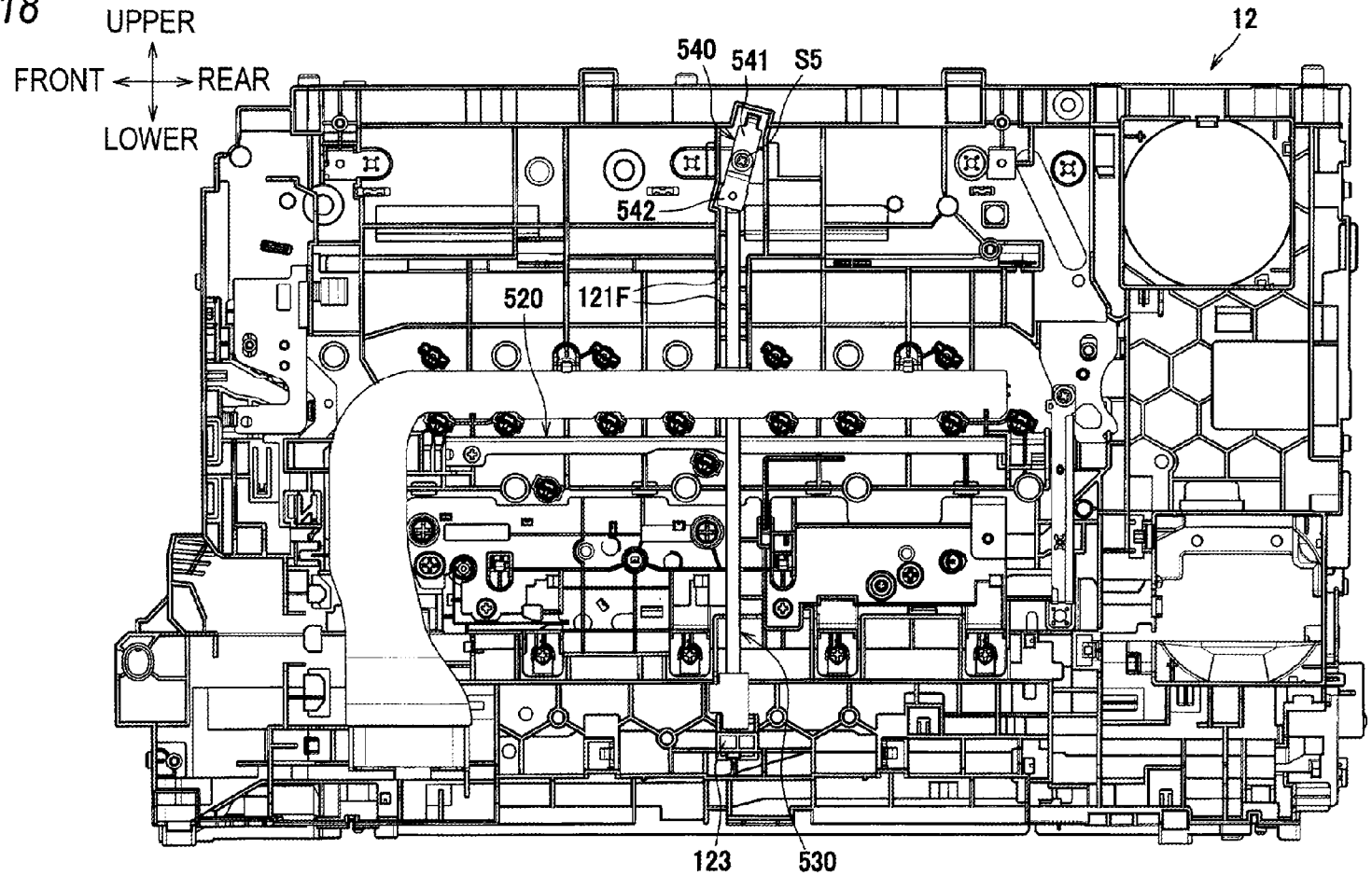
FIG. 18 is a side view of the right side frame according to the illustrative embodiment of FIG. 16, as seen from an outer side in the left-right direction.
Figure 20A:
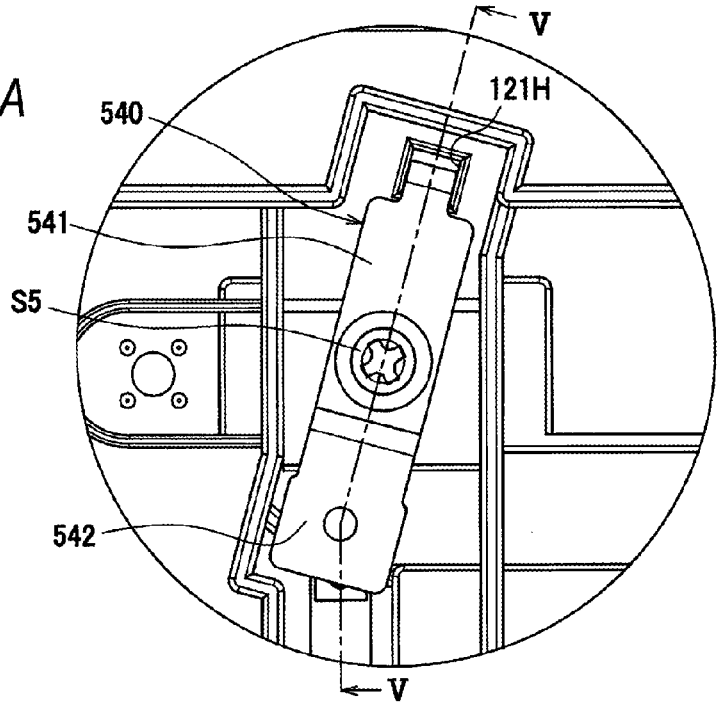
FIG. 20A is an enlarged view of a plate-shaped member.
Figure 20B:
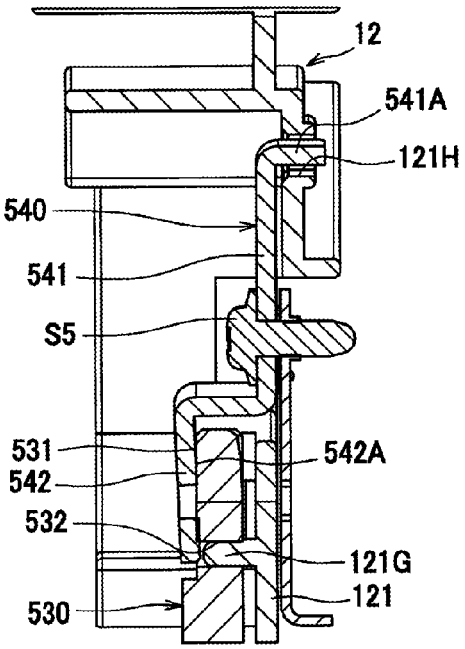
FIG. 20B is a sectional view taken along a line V-V of FIG. 20A.

The plate-shaped member 540 has a first wall part 541 orthogonal to the left-right direction, a second wall part 542 extending outwardly from a lower end portion of the first wall part 541 in the left-right direction and a third wall part 543 extending downwardly from an outer end portion of the second wall part 542 in the left-right direction. As shown in FIGS. 18, 20A and 20B, the first wall part 541 of the plate-shaped member 540 is fixed to the right side frame 12 by a screw S5, and the second wall part 542 is a free end.

The second wall part 542, which is a free end, is configured to urge an upper end portion of the first beam member 530 towards the right side frame 12 (specifically, a support rib 121F, which will be described later), so that the upper end portion of the first beam member 530 is held between the second wall part 542 and the right side frame 12. Thereby, since the upper end portion of the first beam member 530 is elastically held by the plate-shaped member 540, when the load is applied from the drawer 60 to the right side frame 12, it is possible to suppress an attached part between the upper end portion of the first beam member 530 and the right side frame 12 from being damaged by the elastic deformation of the plate-shaped member 540.

Also, as shown in FIG. 20B, a surface of the second wall part 542 facing the first beam member 530 is a second plane part 542A configured to surface-contact the first plane part 531 of the first beam member 530. Thereby, since the second wall part 542 of the plate-shaped member 540 and the upper end portion of the first beam member 530 are surface-contacted at the respective plane parts 531, 542A thereof, it is possible to stably support the upper end portion of the first beam member 530 by the second wall part 542 of the plate-shaped member 540.

Also, the first plane part 531 of the first beam member 530 is formed with a through-hole 532 penetrating from the first plane part 531 towards the right side frame 12. In the through-hole 532, a projection 121G protruding from a surface of the plate-shaped part 121 of the right side frame 12 towards the first beam member 530 is fitted. Thereby, the vertical movement of the first beam member 530 with respect to the right side frame 12 is restrained.

Also, an upper end of the first wall part 541 of the plate-shaped member 540 is formed with an engaging part 541A extending towards an inner side in the left-right direction. The engaging part 541A is configured to be inserted into an engaging hole 121H formed at the plate-shaped part 121 of the right side frame 12 and to be engaged with the engaging hole 121H in a width direction of the plate-shaped member 540.

Figure 19A:
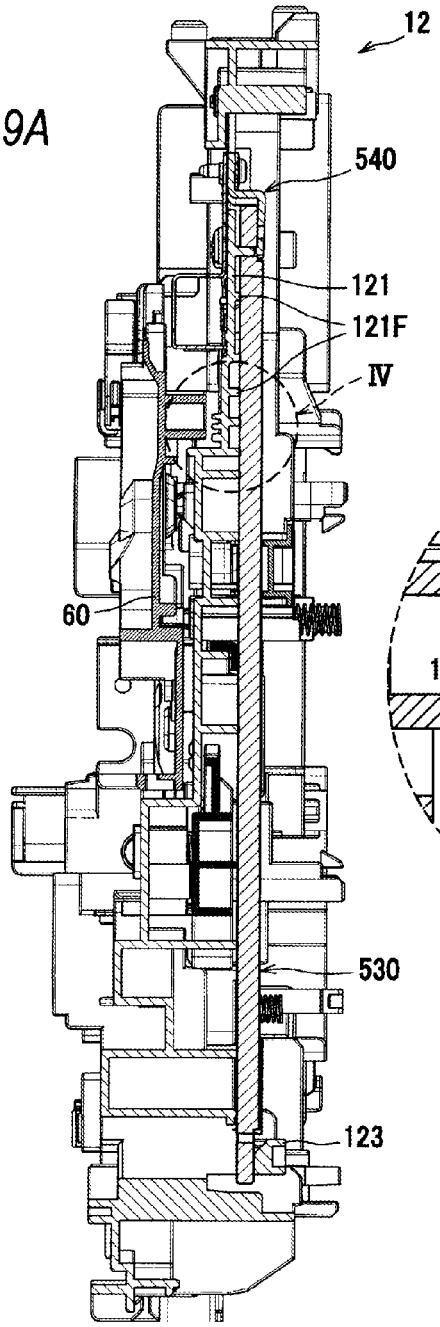
FIG. 19A is a front view of the right side frame according to the illustrative embodiment of FIG. 16, as seen from a front side.
Figure 19A:
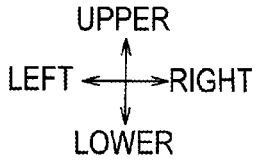
Figure 19B:
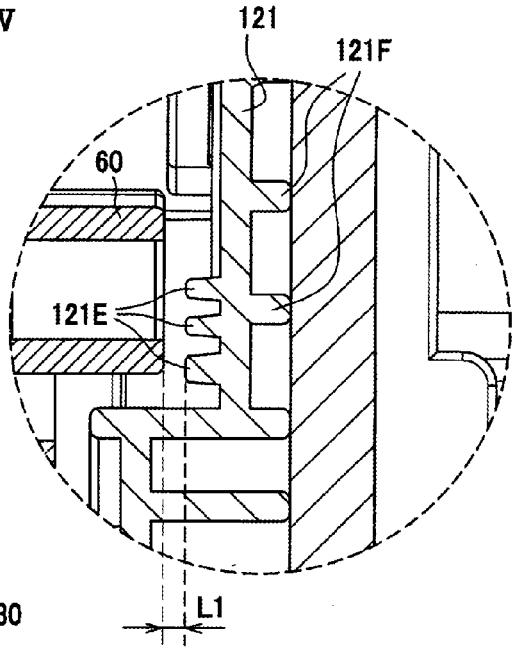
FIG. 19B is an enlarged view of a part denoted with an arrow IV in FIG. 19A.

As shown in FIGS. 17, 19A and 19B, the upper part of the right side frame 12 is formed at its substantial center in the front-rear direction with a plurality of support ribs 121F configured to contact an upper part (a ⅓ part from an upper end) of the first beam member 530. Each support rib 121F is an example of a second rib and protrudes from the surface of the plate-shaped part 121 of the right side frame 12 towards the first beam member 530. The support ribs 121F are arranged side by side in the longitudinal direction of the first beam member 530.

Thereby, when the load is applied from the drawer 60 to the right side frame 12, the right side frame 12 and the first beam member 530 are contacted with each other at a plurality of points. Therefore, the load is dispersed and transmitted to the first beam member 530, so that it is possible to suppress the stress from being concentrated on a specific place of the first beam member 530.

Also, as shown in FIG. 19B, one of the plurality of support ribs 121F overlaps with the two third projection parts 121E positioned at the upper of the three projection parts 121E, as viewed from the left-right direction. Thereby, it is possible to favorably receive the load, which is transmitted from the drawer 60 to the two third projection parts 121E, by the first beam member 530 made of metal through the support rib 121F.

As shown in FIGS. 16 and 17, the duct 600 has a first duct part 610 having a U-shaped section, as viewed from a section opening outwardly in the left-right direction, which is formed integrally with the right side frame 12, a second duct part 620 configured to cover the opening of the U-shaped first duct part 610, as viewed from a section, and a shield member 630 provided in the duct 600. The first duct part 610 and the second duct part 620 have a part extending in the front-rear direction and a part extending in the upper-lower direction, respectively, and have a substantial L shape, as seen in the left-right direction.

Figure 21:
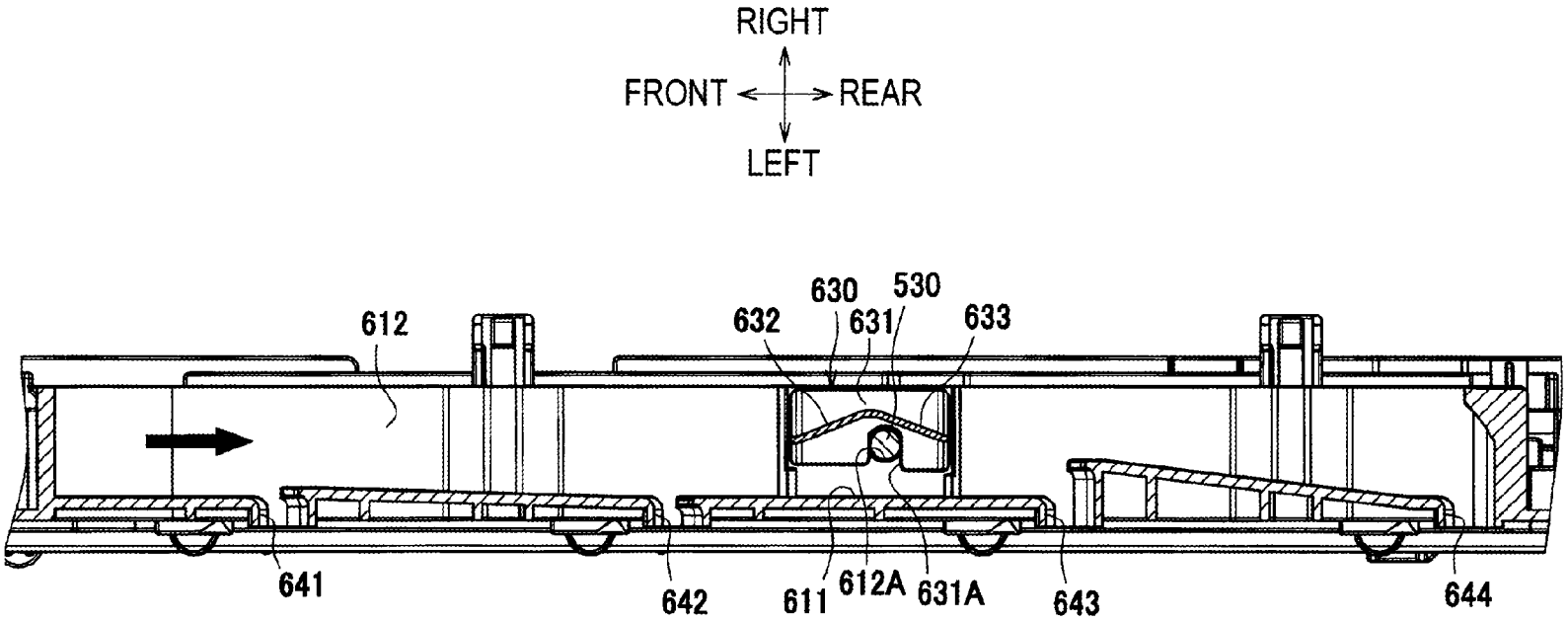
FIG. 21 is a sectional view of a duct.

The first duct part 610 has a bottom wall part 611 and a pair of sidewall parts 612 extending outwardly from upper and lower ends of the bottom wall part 611 in the left-right direction. As shown in FIG. 21, the bottom wall part 611 is formed at positions corresponding to the respective process units 50 with a first exhaust port 641, a second exhaust port 642, a third exhaust port 643 and a fourth exhaust port 644 for exhausting air towards the plurality of chargers 52, which are arranged side by side in the front-rear direction.

As shown in FIGS. 17 and 21, the pair of sidewall parts 612 is formed with recesses 612A through which the first beam-shaped plate 530 passes. The recess 612A has substantially the same width as the diameter of the first beam member 530 and has a larger depth than the diameter of the first beam member 530. Also, a bottom of the recess 612A is arranged at a position spaced outwardly from the bottom wall part 611 in the left-right direction.

The shield member 630 is a member made of resin, and a part thereof is configured to block a part of a flow path in the duct 600. That is, a sectional area of the flow path of the duct 600 is reduced at the part at which the shield member 630 is provided. Specifically, the shield member 630 is arranged between the second exhaust port 642 and the third exhaust port 643 in the front-rear direction and integrally has a pair of sidewalls 631, an upstream-side inclined wall 632 and a downstream-side inclined wall 633.

The respective sidewalls 631 are walls for blocking the recesses 612A, are arranged to contact inner surfaces of the pair of sidewall parts 612 and are formed at appropriate positions with U-shaped recesses 631A having a shape corresponding to the first beam member 530.

The upstream-side inclined wall 632 is provided between the pair of sidewalls 631 and is inclined with respect to a blowing direction (an arrow direction in FIG. 21). Specifically, the upstream-side inclined wall 632 is inclined so that it gradually more deviates from the bottom wall part 611 as it faces towards a downstream side of the blowing direction. Thereby, since it is possible to suppress the sectional area of the flow path from being sharply reduced in the vicinity of the shield member 630, it is possible to enable the air to smoothly flow in the duct 600.

The downstream-side inclined wall 633 is provided between the pair of sidewalls 631 and at a downstream side of the upstream-side inclined wall 632 in the blowing direction and is inclined with respect to the blowing direction. Specifically, the downstream-side inclined wall 633 is inclined so that the downstream-side inclined wall 633 is gradually closer to the bottom wall part 611 as it faces towards the downstream side of the blowing direction. Thereby, since it is possible to suppress the sectional area of the flow path from being sharply increased at the downstream side of the upstream-side inclined wall 632, it is possible to enable the air to smoothly flow in the duct 600.

The upstream-side inclined wall 632 and the downstream-side inclined wall 633 are arranged with being spaced from the second duct part 620 (refer to FIG. 17) and the bottom wall part 611. Thereby, it is possible to enable the air to flow at both sides of the upstream-side inclined wall 632 and the downstream-side inclined wall 633 in the left-right direction.

The first beam member 530 is arranged to pass between the upstream-side inclined wall 632 and the downstream-side inclined wall 633. Thereby, since it is possible to suppress the air flow from being scattered due to the first beam member 530 by the upstream-side inclined wall 632 and the downstream-side inclined wall 633, it is possible to enable the air to smoothly flow in the duct 600.

Also, since the first beam member 530 has a cylindrical shape, i.e., a compact shape, it is possible to easily accommodate the first beam member 530 between the upstream-side inclined wall 632 and the downstream-side inclined wall 633, so that it is possible to suppress the first beam member 530 from disturbing the air flow.

According to the above image forming apparatus, since it is possible to transmit the load from the support member to the one end portion-side of the frame, which is difficult to be deformed, through the projection part, it is possible to suppress the deformation of the frame.

According to the above image forming apparatus, since it is possible to bring the projection part closer to the one end portion of the frame, as compared to a structure where the projection part is arranged at a position at which the projection part can be contacted to a part closer to the central part of the support member than the one end portion thereof, it is possible to further suppress the deformation of the frame.

According to the above image forming apparatus, when the first interval and the second interval are made to be the same, for example, it is possible to disperse the load from the support member to both the projection part and the support projections, so that it is possible to suppress the deformation of the frame. Also, when the first interval is smaller than the second interval, for example, the projection part is earlier contacted to the support member than the support projections. Therefore, also in this case, since the load from the support member can be transmitted to the end portion-side of the frame, which is difficult to be deformed, it is possible to suppress the deformation of the frame.

According to the above image forming apparatus, since the load from the support member can be dispersed to the frame from both end portions of the support member through the projection part, it is possible to further suppress the deformation of the frame.

According to the above image forming apparatus, when the projection part is also provided at a position at which the projection part can be contacted to one end portion of the support member in the arrangement direction, for example, since it is possible to disperse the load from the support member to the respective projection parts, it is possible to further suppress the deformation of the frame. According to the above image forming apparatus, since it is possible to disperse the load from the support member to the first long rib, it is possible to favorably suppress the deformation of the frame.

According to the above image forming apparatus, it is possible to favorably receive the load transmitted to the first rib from the support member by the first beam member made of metal through the second rib.

According to the above image forming apparatus, when the high load is applied to the image forming apparatus, for example, when the image forming apparatus is dropped, even though the frame is deformed around the second beam member, it is possible to suppress the deformation by the first beam member having the higher stiffness than the second beam member.

According to the above image forming apparatus, when the high load is applied to the frame from the plurality of image forming units, for example, when the image forming apparatus is dropped, the load from the plurality of image forming units is collectively received by the second beam member extending in the arrangement direction of the plurality of image forming units and then by the first beam member having the higher stiffness than the second beam member. Therefore, it is possible to effectively receive the load by the respective beam member, thereby According to the above image forming apparatus, it is possible to make the first beam member compact.

According to the above image forming apparatus, since the one end portion of the first beam member is elastically held by the elastic member, when the load is applied to the support member from the image forming units, it is possible to suppress an attached part between the one end portion of the first beam member and the frame from being damaged by the elastic deformation of the elastic member.

According to the above image forming apparatus, since the other part of the elastic member and the one end portion of the first beam member are surface-contacted at the respective plane parts, it is possible to stably support the one end portion of the first beam member by the other part 542 of the elastic member.

In the above illustrative embodiments, the first beam member (for example, the first beam member 530) is arranged to extend in the direction orthogonal to the arrangement direction of the plurality of process units 50. However, this disclosure is not limited thereto. For example, the first beam member may be arranged to intersect with the arrangement direction and may be arranged to be inclined with respect to the arrangement direction.

In the above illustrative embodiment, the process unit 50 has been exemplified as the image forming unit. However, this disclosure is not limited thereto. For example, the image forming unit may be a drum cartridge to which a developing cartridge having a developing roller is detachably mounted and has a photosensitive drum.

In the above illustrative embodiment, the plate-shaped member 540 has been exemplified as the elastic member. However, this disclosure is not limited thereto. For example, the elastic member may be a plate-shaped member made of resin or a rod-shaped member made of metal or resin.

In the above illustrative embodiment, the electrode is configured to have the compression coil spring. However, this disclosure is not limited thereto. For example, the electrode may be configured to have a plate spring or torsion spring.

In the above illustrative embodiment, this disclosure is applied to the color printer 1. However, this disclosure is not limited thereto. For example, this disclosure can be also applied to the other image forming apparatus, such as a monochrome printer, a copier, a complex machine and the like.

What is claimed is:

1. An image forming apparatus comprising:

a plurality of image forming units respectively having a photosensitive drum rotatable about a rotary axis and arranged side by side in an arrangement direction orthogonal to the rotary axis;

a support member configured to support the plurality of image forming units;

a frame, which is made of resin, is arranged at one end-side of the photosensitive drum in a direction of the rotary axis and is configured to support the support member;

a first beam member, which is made of metal, has a long shape extending in the orthogonal direction, is arranged along an outer surface of the frame and is fixed to the frame; and a plurality of electrodes, which is supported to the frame and is configured to supply power to the plurality of image forming units, wherein the frame comprises:

a plurality of support projections, which protrudes inwardly from an inner surface of the frame and is configured to support the plurality of electrodes, and a projection part, which is arranged at an outer position of the plurality of support projections, at which the projection part overlaps with the support member, as viewed from the direction of the rotary axis, and is contactable to the support member in a case where the support member is moved towards the frame.

2. The image forming apparatus according to claim 1, wherein the projection part is provided at a position closer to one end portion of the frame than the plurality of support projections in the arrangement direction of the plurality of image forming units.

3. The image forming apparatus according to claim 2, wherein the projection part is arranged at a position at which the projection part is contactable to one end portion of the support member in the arrangement direction of the plurality of image forming units.

4. The image forming apparatus according to claim 1, wherein a first interval, in the direction of the rotary axis between, the projection part and the support member is equal to or smaller than a second interval, in the direction of the rotary axis, between the support projections and the support member.

5. The image forming apparatus according to claim 1, wherein the projection part is arranged at a position at which the projection part is contactable to both end portions of the support member in an arrangement direction of the plurality of image forming units.

6. The image forming apparatus according to claim 1, wherein the projection part is arranged at a position at which the projection part is contactable to one end portion of the support member in an orthogonal direction orthogonal to an arrangement direction of the plurality of image forming units.

7. The image forming apparatus according to claim 6, wherein the projection part capable of contacting one end portion of the support member in the orthogonal direction is a first rib, which has a long shape extending in the arrangement direction.

8. The image forming apparatus according to claim 7, further comprising:

a second rib, which protrudes from the outer surface of the frame and is configured to contact the first beam member, wherein the first rib and the second rib overlap with each other, as viewed from the direction of the rotary axis.

9. The image forming apparatus according to claim 8, further comprising a second beam member, which is made of metal, has a long shape extending in the arrangement direction, is arranged along the outer surface of the frame and to intersect with the first beam member and is fixed to the frame, wherein stiffness of the first beam member is higher than stiffness of the second beam member.

10. The image forming apparatus according to claim 9, wherein the first beam member is arranged to contact the second beam member at an opposite side to the image forming units with respect to the second beam member.

11. The image forming apparatus according to claim 8, wherein the first beam member has a cylindrical shape.

12. The image forming apparatus according to claim 8, further comprising an elastic member including a part fixed to the frame and another part, which is a free end, wherein one end portion of the first beam member is held between the other part of the elastic member and the frame.

13. The image forming apparatus according to claim 12, wherein one end portion of the first beam member is provided with a first plane part along a longitudinal direction of the first beam member, and wherein the other part of the elastic member is provided with a second plane part configured to surface-contact the first plane part.

* * * * *